US008245656B2

(12) United States Patent
Mori et al.

(10) Patent No.: US 8,245,656 B2
(45) Date of Patent: Aug. 21, 2012

(54) SEWING MACHINE, COMPUTER READABLE MEDIUM STORING THREAD TENSION ADJUSTMENT PROGRAM FOR SEWING MACHINE, AND THREAD TENSION EVALUATION UNIT

(75) Inventors: Tomohiko Mori, Inazawa (JP); Yasuo Miyake, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 388 days.

(21) Appl. No.: 12/588,807

(22) Filed: Oct. 28, 2009

(65) Prior Publication Data

US 2010/0199902 A1 Aug. 12, 2010

(30) Foreign Application Priority Data

Feb. 12, 2009 (JP) ..... 2009-029941
Feb. 12, 2009 (JP) ..... 2009-029942

(51) Int. Cl.
*D05B 19/00* (2006.01)

(52) U.S. Cl. ..... 112/456

(58) Field of Classification Search ..... 700/138, 700/139; 112/456, 102.5, 458, 464, 233, 112/254, 475.01, 475.02, 475.03, 475.04, 112/470.02, 470.03, 470.06
See application file for complete search history.

(56) References Cited

U.S. PATENT DOCUMENTS 4,982,674 A * 1/1991 Hayakawa ..... 112/102.5
5,323,722 A * 6/1994 Goto et al. ..... 112/102.5
6,994,042 B2 * 2/2006 Schweizer ..... 112/470.03
7,620,472 B2 * 11/2009 Hamajima ..... 700/136
7,806,063 B2 * 10/2010 Shimizu ..... 112/278

FOREIGN PATENT DOCUMENTS

JP A-7-313771 12/1995

* cited by examiner

*Primary Examiner* — Tejash Patel
(74) *Attorney, Agent, or Firm* — Oliff & Berridge, PLC

(57) ABSTRACT

A sewing machine including an image capturing unit disposed at a position capable of capturing images of the stitches formed on the workpiece cloth and capturing images of the stitches at least from either upper and undersides of the workpiece cloth; an extracting section that extracts, from the image data of the stitches captured by the image capturing unit, a region occupied by an opposite side thread appearing at an interlace of the needle thread and the bobbin thread; a calculating section calculating an area of the extracted region; an evaluating section that evaluates a tension balance between the needle thread and the bobbin thread based on the area calculated by the calculating section; and a controller controlling the thread tension adjustment mechanism to modify the tension balance of the stitches based on a result of evaluation by the evaluating section.

17 Claims, 19 Drawing Sheets

| THREAD TENSION RATE | MOVEMENT AMOUNT OF THREAD TENSION PULSE MOTOR |
|---|---|
| ~0.74 | -6 PULSE |
| 0.75~0.84 | -4 PULSE |
| 0.85~0.94 | -2 PULSE |
| 0.95~1.05 | NO MOVEMENT (APPROPRIATE THREAD TENSION) |
| 1.06~1.20 | +2 PULSE |
| 1.21~1.40 | +4 PULSE |
| 1.41~ | +6 PULSE |

FIG.14

SEWING MACHINE, COMPUTER READABLE MEDIUM STORING THREAD TENSION ADJUSTMENT PROGRAM FOR SEWING MACHINE, AND THREAD TENSION EVALUATION UNIT

CROSS-REFERENCE TO RELATED APPLICATIONS

This application is based upon and claims the benefit of priority from the prior Japanese Patent Applications 2009-029941, filed on, Feb. 12, 2009 and 2009-029942, filed on, Feb. 12, 2009 the entire contents of which are incorporated herein by reference.

FIELD

The present disclosure relates to a sewing machine provided with a thread tension adjustment mechanism that adjusts at least either needle thread tension and bobbin thread tension, a computer readable medium that stores a thread tension adjustment program for execution by the sewing machine to provide automatic thread tension/tension balance adjustment, and a thread tension evaluating unit that evaluates the tension balance representing the balance between the needle thread and bobbin thread that constitute stitches formed on a workpiece cloth.

BACKGROUND

Sewing machines that form stitches on a workpiece cloth with a needle thread and a bobbin thread are generally provided with a thread tension unit, which adjusts needle thread tension provided on a needle thread path of a sewing machine arm. The thread tension unit, being operated by the user, optimizes the tension balance, which is a balance in tension exerted on the needle thread and the bobbin thread of stitches formed on the workpiece cloth to allow smooth and precise sewing operation. Conventionally, adjustment in tension balance at thread tension unit has been performed by evaluating the tension balance through visual observation of test stitches, for example, formed on the workpiece cloth.

Since such evaluation is based on the user's subjective view point, the evaluation becomes somewhat ambiguous. Further, accurate evaluation of thread tension/tension balance is a troublesome task for inexperienced users, and thus, may often lead to sewing operations executed under improper tension balance.

To address such problems, sewing machines have been conceived that makes automatic adjustments in tension balance. Such sewing machines are provided with a needle thread stitch detector and a bobbin thread stitch detector at the sewing machine body for optically detecting where, in the thickness of the workpiece cloth, the seam is formed, in other words, the depth in which the needle thread and the bobbin thread are interlaced to form a loop.

The above mentioned needle thread and bobbin thread detectors impinge a slit light on the seams of the workpiece cloth and detect the reflective light with a line sensor. Then, based on the detection of the line sensor, the height of the contour of the seam is detected to determine the depth of the seam or the point where the threads are interlaced from the detected height. However, the problem with such approach of detecting the height of the contour of the thread by way of a reflective detector is that precision in detecting the depth of interlace is readily affected by ambient light and the features of the workpiece such as color, design, and surface brilliance and thus could not sufficiently improve the quality of detection. Thus, evaluation of tension balance was not precise enough under the conventional configuration.

SUMMARY

One object of the present disclosure is to provide a sewing machine capable of automatic evaluation and adjustment of thread tension/tension balance with improved precision and a computer readable medium storing a thread tension adjustment program for use in the sewing machine to provide the above described capabilities. Another object of the present disclosure is to provide a thread tension evaluation unit that improves the accuracy of evaluation of thread tension independent of the user's subjective view point.

In one aspect, a sewing machine of the present disclosure includes a feed mechanism that transfers a workpiece cloth; a stitch forming mechanism that forms stitches on the workipece cloth being transferred by the feed mechanism by interlacing a needle thread and a bobbin thread; a thread tension adjustment mechanism that adjusts at least either of a needle thread tension applied on the needle thread and a bobbin thread tension applied on the bobbin thread; an image capturing unit that is disposed at a position capable of capturing images of the stitches formed on the workpiece cloth and that captures images of the stitches at least from one of upper and undersides of the workpiece cloth; an extracting section that extracts, from the image data of the stitches captured by the image capturing unit, a region occupied by an opposite side thread appearing at an interlace of the needle thread and the bobbin thread; a calculating section that calculates an area of the region occupied by the opposite side thread extracted by the extracting section; an evaluating section that evaluates a tension balance between the needle thread and the bobbin thread based on the area calculated by the calculating section; and a controller that controls the thread tension adjustment mechanism to modify the tension balance of the stitches formed by the stitch forming mechanism based on a result of evaluation by the evaluating section.

In another aspect, a thread tension evaluation unit of the present disclosure evaluates a tension balance of a needle thread and a bobbin thread being interlaced to form stitches on a workpiece cloth and the thread tension evaluation unit includes an image capturing unit that captures images of the stitches at least from either upper and undersides of the workpiece cloth; an extracting section that extracts, from the image data of the stitches captured by the image capturing unit, a region occupied by an opposite side thread appearing at an interlace of the needle thread and the bobbin thread; a calculating section that calculates an area of the region occupied by the opposite side thread extracted by the extracting section; an evaluating section that evaluates thread tension based on the area calculated by the calculating section; and an output unit that outputs a result of evaluation by the evaluating section.

BRIEF DESCRIPTION OF THE DRAWINGS

Other objects, features and advantages of the present disclosure will become clear upon reviewing the following description of the illustrative aspects with reference to the accompanying drawings, in which.

FIG. 14 indicates a modification data table;

DETAILED DESCRIPTION

Figure 1:
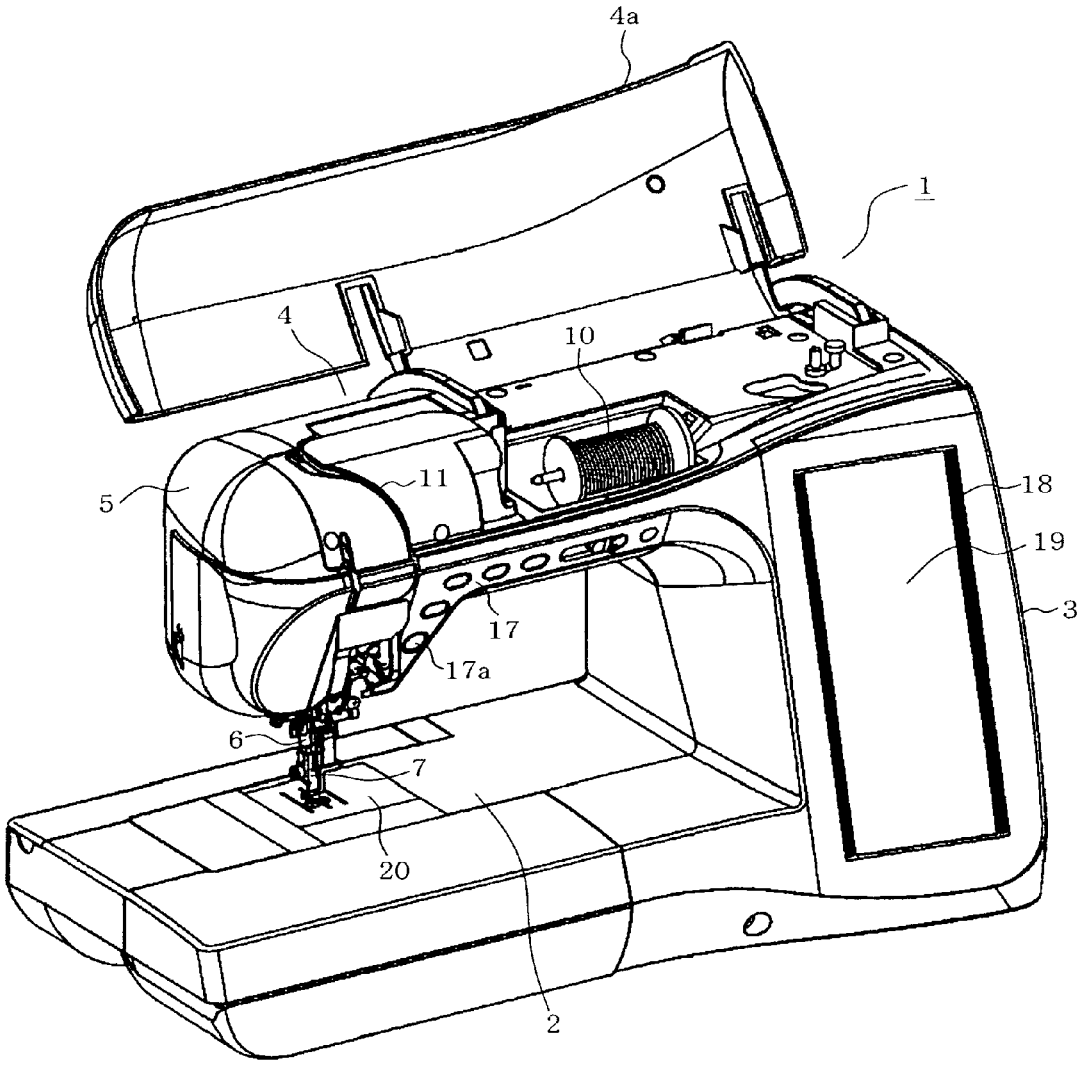
FIG. 1 is a perspective view of a sewing machine according to a first exemplary embodiment.

A description will be given hereinafter on a first exemplary embodiment of the present disclosure with reference to FIGS. 1 to 14. The description will be given through an example of a household electronic sewing machine, which is hereinafter referred to as sewing machine for simplicity. FIG. 1 provides an overall view of the sewing machine according to the first exemplary embodiment seen from a position in the front side of the sewing machine. As shown in FIG. 1, sewing machine body 1 of the sewing machine is integrally provided with sewing machine bed 2 extending in the left and right direction, pillar 3 extending upward from the right end of sewing machine bed 2, and arm 3 extending leftward as viewed in FIG. 1 from the upper end of pillar 3. The extreme end of arm 4 constitutes sewing machine head 5. For the ease of explanation, the direction in which the user operating sewing machine body 1 positions himself relative to sewing machine body 1 is defined as the front and the opposite direction as the rear. The side on which pillar 3 stands is defined as the right side and the opposite side is defined as the left side.

Figure 2:
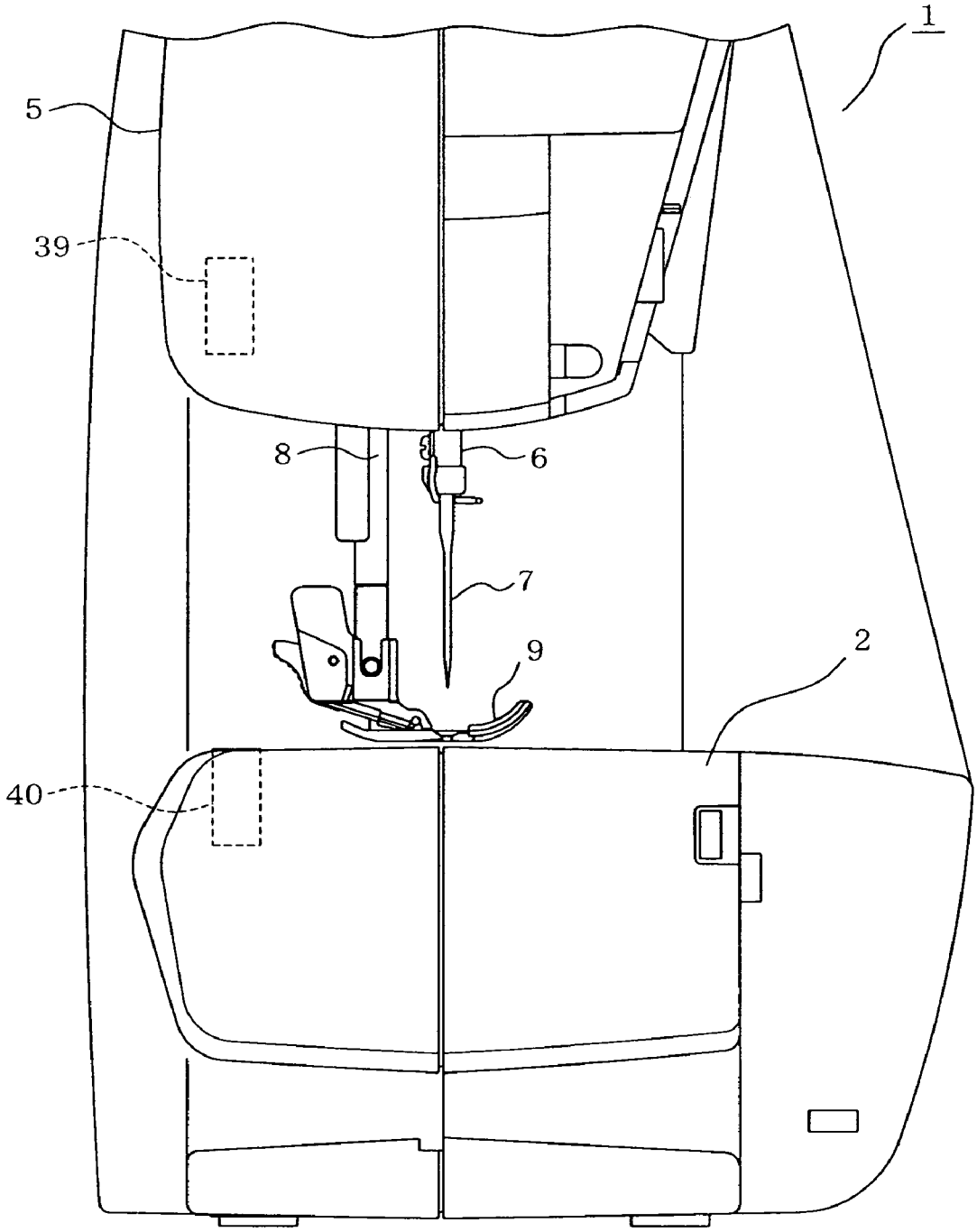
FIG. 2 is a left side view of a sewing machine body for indicating the positioning of a camera.

As also shown in FIG. 2, sewing machine head 5 situated at the extreme end of arm 4 has a needle bar 6 configured to be swingable up and down and to the left and right. Needle bar 6 has a sewing needle 7 attached to its lower end. As shown in FIG. 2, a presser bar 8 is further provided to extend out of head 5 so as to be situated behind needle bar 6. At the lower end of presser bar 8, a presser foot 9 is mounted for pressing workpiece cloth W shown in FIG. 6 against needle plate 20. As shown in FIG. 1, the upper portion of arm 4 is covered openably/closably by cover 4*a*. Beneath cover 4*a*, a needle thread spool 10 is provided for supplying needle thread NT as shown in FIG. 6.

Figure 3:
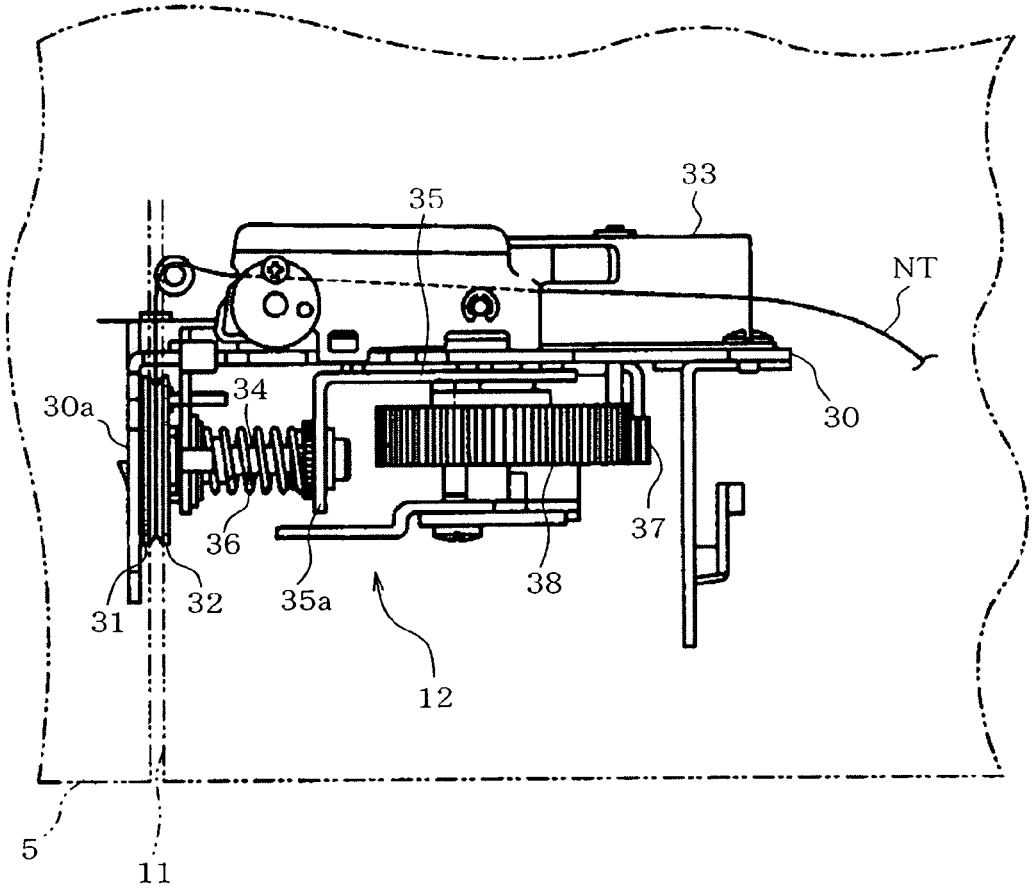
FIG. 3 is a plan view depicting a configuration of a thread tension adjustment mechanism.

On the front face of arm 4, a vertically extending thread guide groove 11 that constitutes the needle thread path is provided for guiding needle thread NT drawn from thread spool 10 to sewing needle 7. Arm 4 contains thread tension adjustment mechanism 12 as can be seen in FIG. 3. As will be later described in detail, thread tension adjustment mechanism 12 applies tension on needle thread NT passed through thread guide groove 11 and is capable of making automatic adjustments in thread tension. Needle thread NT drawn from thread spool 10 is passed through thread guide groove 11 to be tensed by thread tension adjustment mechanism 12 and further engaged with a check spring and a thread take-up not shown to be ultimately passed through an eye sewing needle 7 not shown.

Figure 5:
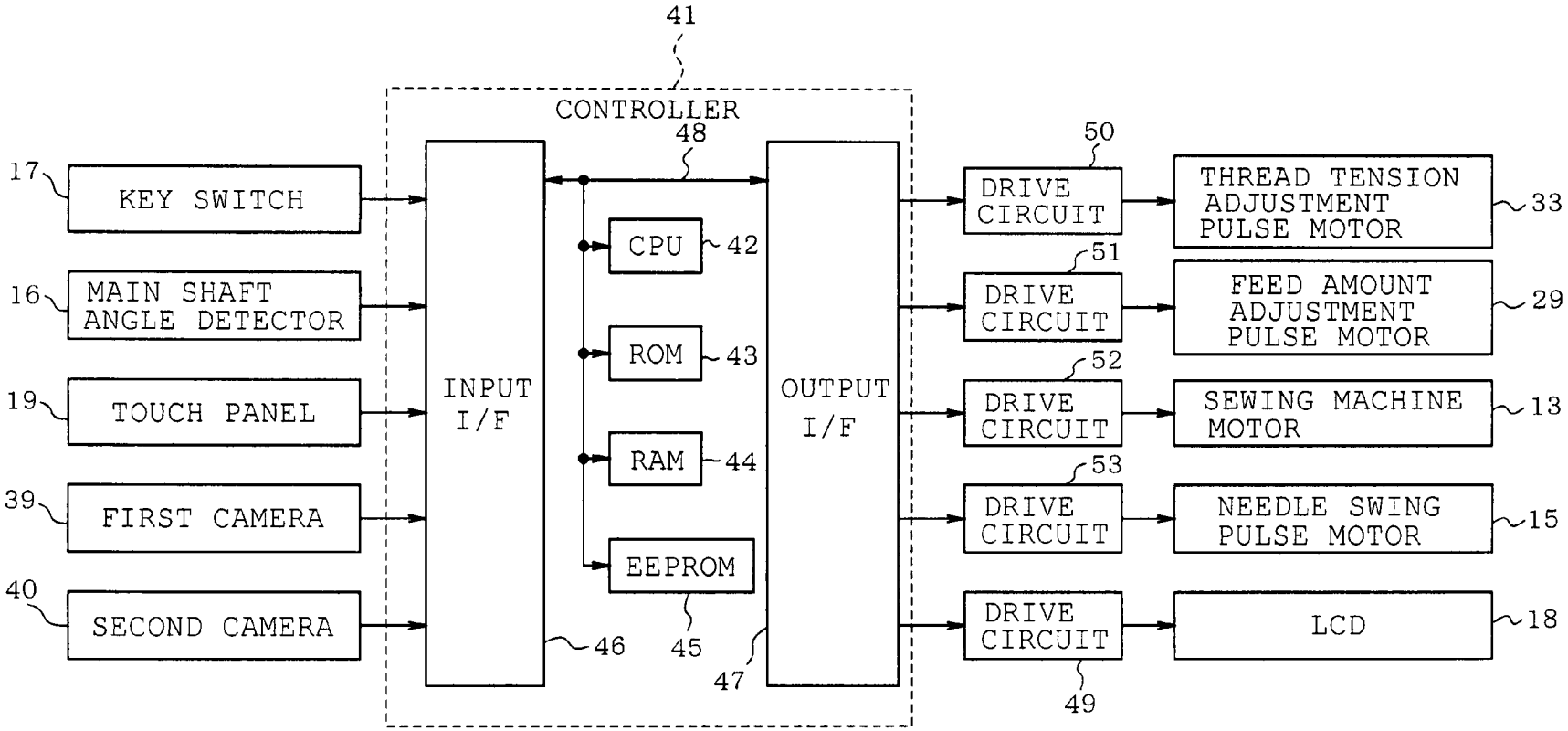
FIG. 5 is a block diagram indicating an electrical configuration of the sewing machine.

Though not shown in detail, arm 4 further contains components such as a sewing machine main shaft being driven in rotation by sewing machine motor 13 shown in FIG. 5. Yet, further, arm 4 contains a needle bar drive mechanism that moves needle bar 6 up and down by the drive force of the sewing machine main shaft, a needle bar swing mechanism that swings needle bar 6 to the left and right, in other words, the X-direction by way of a needle swing pulse motor 15 shown in FIG. 5, and a thread take-up drive mechanism. The sewing machine main shaft is provided with main shaft angle detector 16 shown in FIG. 5 for detecting the rotational angle of the sewing machine main shaft and consequently the vertical position of needle bar 6.

On the front face of arm 4, as shown in FIG. 1, various switch keys such as a start/stop switch 17*a* to instruct start and stop of sewing is provided for user operation. On the front face of pillar 3, a sizable and vertically elongate liquid crystal display 18, referred to as LCD 18 for simplicity hereinafter, is provided which is capable of displaying in full color. LCD 18 is provided with touch panel 19 on its surface as shown in FIG. 5. LCD 18 displays various sewing information such as various utility stitches and embroidery patterns, names of various functionalities to be executed in a sewing operation, and various messages.

Figure 4:
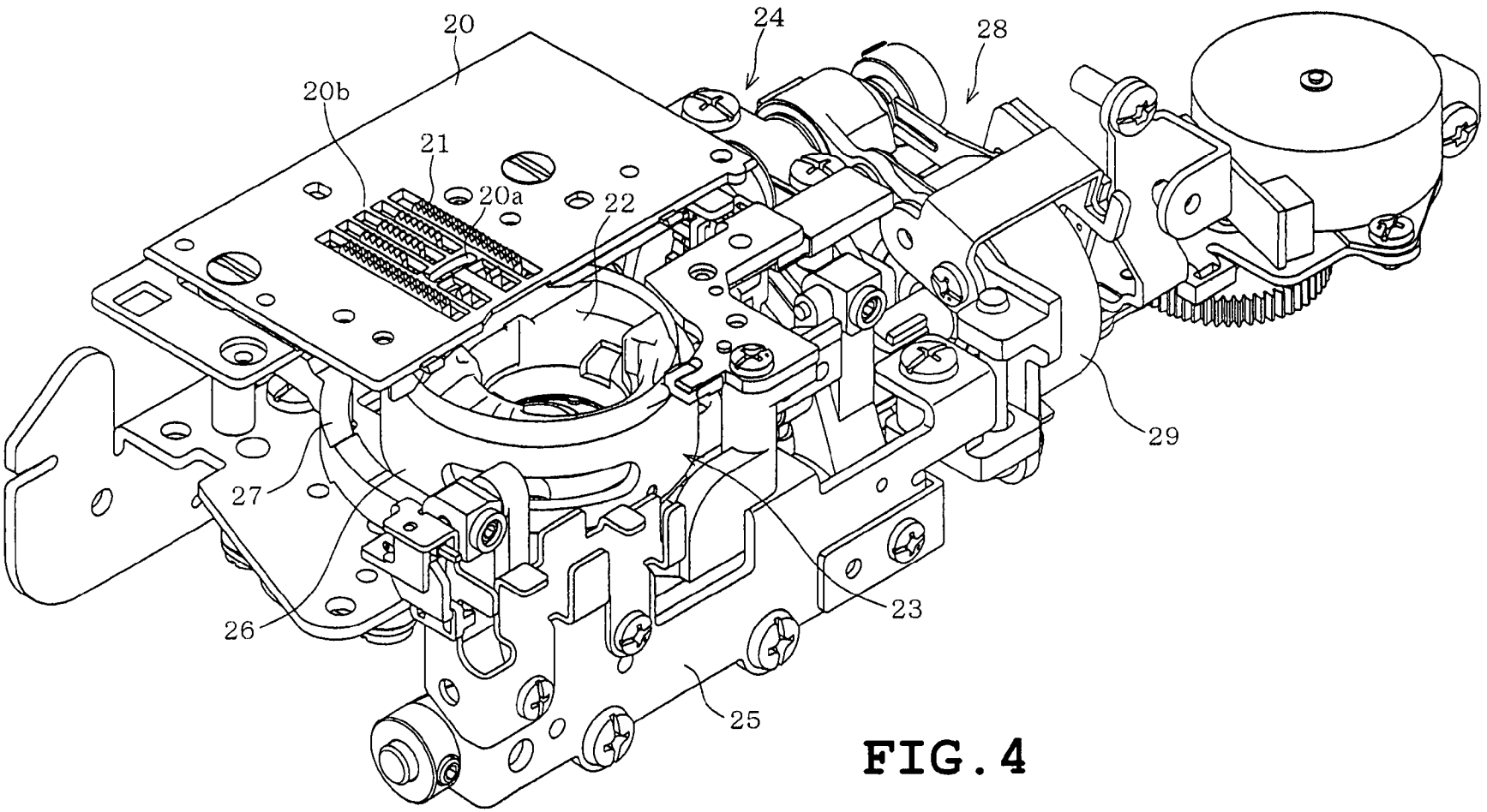
FIG. 4 is a perspective view of a rotary shuttle mechanism and a feed dog drive mechanism.

On the upper surface of sewing machine bed 2, a needle plate 20 is provided as shown in FIGS. 1 and 4 so as to oppose needle bar 6. As can be seen in FIG. 4, needle plate 20 has a needle hole 20*a* for penetration of sewing needle 7 and an opening 20*b* for allowing feed dog 21 to move up and down and back and forth within it to move workpiece cloth W shown in FIG. 6 rearward pitch-by-pitch. Though not shown, sewing machine bed 2 contains a lower shaft extending in the left and right direction which is driven in synchronism with sewing machine main shaft by sewing machine motor 13.

As further shown in FIG. 4 within sewing machine bed 2 below the needle plate are components such as horizontal shuttle mechanism 23 that forms stitches in cooperation with sewing needle 7 and a feed dog drive mechanism 24 that drives the feed dog 21 synchronism with the vertical movement of needle bar 6. The above described components are unitized in assembly with a generally rectangular frame 25.

Horizontal shuttle mechanism 23 includes outer shuttle 26 and inner shuttle 22 provided unrotatably within outer shuttle 26. As well known, outer shuttle 26 is driven in rotation by converting the rotation of the lower shaft into a rotation about a vertical shaft by a gear mechanism not shown. Though not shown, inner shuttle 22 has a bobbin thread bobbin detachably attached within it. The bobbin thread bobbin has bobbin thread BT shown in FIG. 6 wound on it. Inner shuttle 22 has a tension applier not shown configured by components such as a leaf spring. The tension applier applies a predetermined tension on bobbin thread BT drawn from the bobbin thread bobbin so that bobbin thread BT may be sewn under a tensed state. This means that the tension of bobbin thread BT is constant and invariable.

Though not shown nor described in detail, feed dog drive mechanism 24 is provided with feed dog support mechanism 27 that allows feed dog 21 to be supported by frame 25 and feed adjustment mechanism 28 that makes adjustments in the feed amount of feed dog support mechanism 27. Feed dog support mechanism 27 includes a vertically moving mechanism that converts the drive force of the lower shaft into a vertical, in other words, up and down movement of feed dog 21 and a longitudinal feed mechanism that converts the drive force of lower shaft into a longitudinal or back and forth movement of feed dog 21. Feed adjustment mechanism 28, being driven by pulse motor 29, is configured to make adjustments or modification in the feed amount of feed dog 21, that is, the amount of longitudinal movement.

Figure 6A:
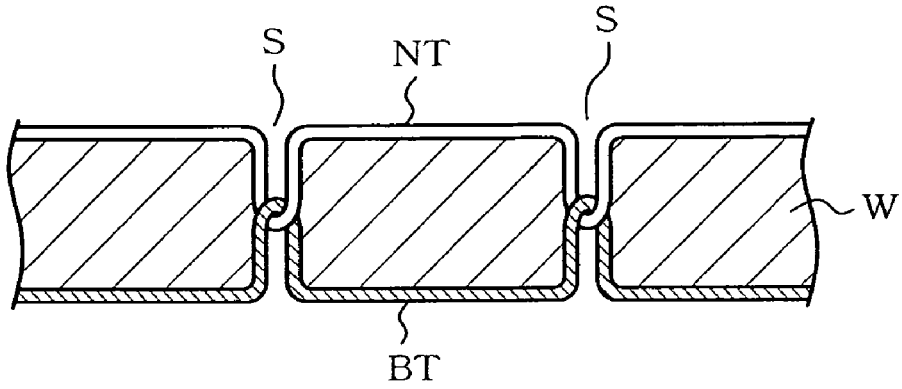
FIG. 6A is an enlarged schematic vertical cross sectional view of stitches being formed on a workpiece cloth with appropriate thread tension.
Figure 6B:
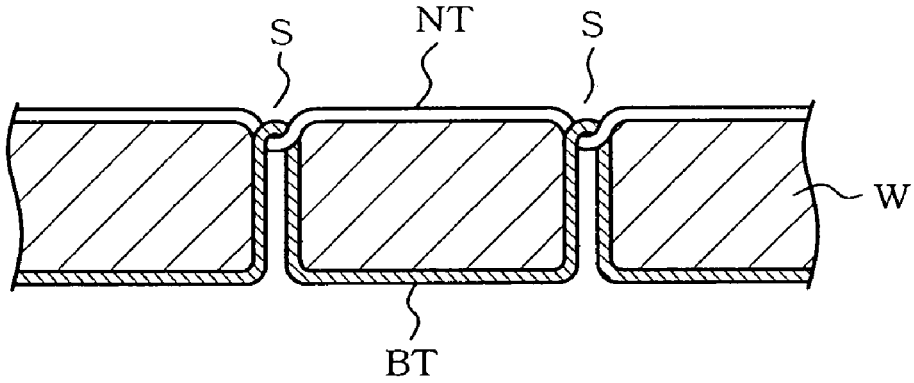
FIG. 6B is an enlarged schematic vertical cross sectional view of the stitches being formed on the workpiece cloth when a needle thread tension is relatively greater than the bobbin thread tension.
Figure 6C:
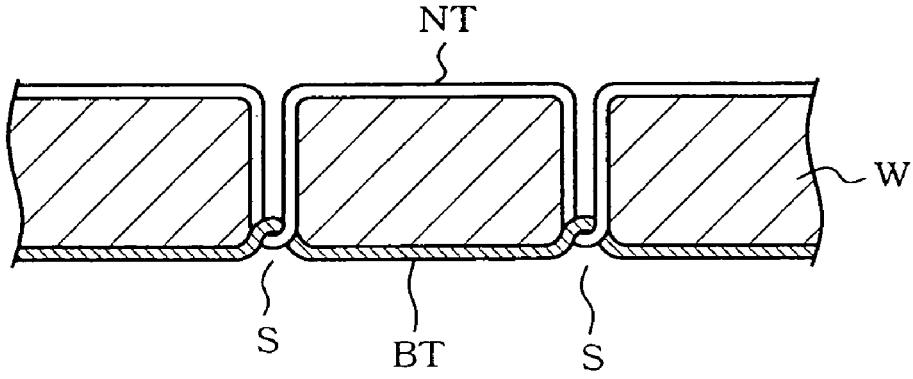
FIG. 6C is an enlarged schematic vertical cross sectional view of the stitches being formed on the workpiece cloth when the bobbin thread tension is relatively greater than the needle thread tension.

Thus, when sewing machine motor 13 is driven to execute the sewing operation at sewing machine body 1, workpiece cloth W placed on sewing machine bed 2 is fed pitch-by-pitch in the rearward direction or leftward direction as viewed in FIG. 2 while driving needle bar 6 and rotary shuttle mechanism 23. Thus, as can be seen in FIGS. 6A to 6C, stitches are formed on workpiece cloth W by interlacing needle thread NT and bobbin thread BT. Thread tension or tension balance, which is the balance of tension between needle thread NT and bobbin thread BT, is adjustable by thread tension mechanism 12.

FIG. 3 shows the configuration of thread tension mechanism 12 installed within arm 4. Thread tension adjustment mechanism 12 is assembled with mount plate 30 provided within arm 4. Thread tension adjustment mechanism 12 is provided with a couple of stationary thread tension disc 31 and movable thread tension disc 32 situated far back inside thread guide groove 11. The couple of stationary thread tension disc 31 and movable thread tension disc 32 applies tension on needle thread NT passed through thread guide groove 11 by clamping needle thread NT from the left and right sides. Adjustment mechanism is further provided that is driven by pulse motor 33 for adjustment in the strength of clamping by the couple of thread tension discs 31 and 32.

Mount plate 30 is configured by a main portion oriented in the front and back direction and elongate in the left and right direction. At the left end of main portion, a forwardly extending bend 30*a* is provided so as to face the left side of thread guide groove 11. On the right side surface of bend 30*a*, thread tension shaft 34 is mounted so as to extend rightward. Thread tension discs 31 and 32 come in the form of a disc having a central through hole for insertion of thread tension shaft 34. Stationary thread tension disc 31 is secured unmovably on the left end of thread tension shaft 34 while movable thread tension disc 32, through which thread tension shaft 34 penetrates, is provided on the right side of stationary thread tension disc 31 so as to be movable in the left and right direction.

On the front face of mount plate 30, adjustment plate 35 movable in the left and right direction and being formed in an L-shape in top view is provided which was described earlier as a tension applier. At the left end of adjustment plate 35, spring receiver 35*a* extends forward so as to receive the right end portion of thread tension shaft 34 through it. Compression coil spring 36 is fitted over thread tension shaft 34 so as to be situated between movable thread tension disc 32 and spring receiver 35*a* of adjustment plate 35. On the output shaft of pulse motor 33 mounted on mount plate 30, small-diameter gear 37 is provided that is in mesh with large-diameter drive gear 38 mounted rotatably on mount plate 30.

Figure 8:
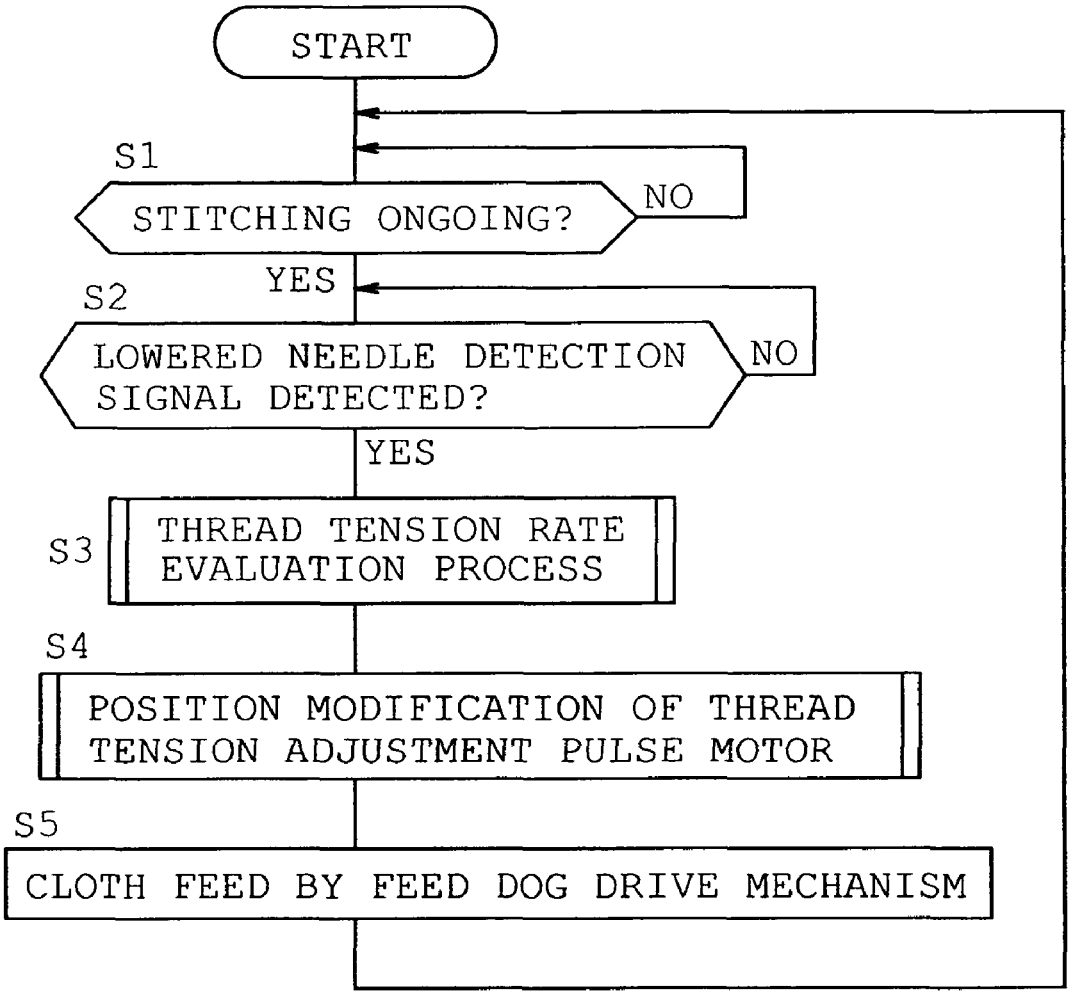
FIG. 8 is a flowchart indicating the entire process flow of thread tension adjustment executed by a controller.

Though not shown in detail, on the side surface or the rear side as viewed in FIG. 8 of drive gear 38, a helical cam groove is provided which engaged with an engagement pin provided on the right end side of adjustment plate 35. Thus, when pulse motor 33 is driven, the rotation of drive gear 38 causes engagement pin to be moved within the helical cam groove to allow adjustment in the positioning of adjustment plate 35 in the left and right direction. Thus, the spring force of compression coil spring 36, in other words, the force to press movable thread tension disc 32 against stationary thread tension disc 31 is altered to make adjustments in thread tension. For instance, when pulse motor 33 is driven by negative pulses, adjustment plate 35 is moved rightward to reduce the tension of needle thread NT, whereas when pulse motor 33 is driven in positive pulses, adjustment plate 35 is moved leftward to increase the thread tension of needle thread NT.

In the present exemplary embodiment, sewing machine body 1 is provided with mechanisms for evaluating the thread tension, in other words, the tension balance of the stitches formed on workpiece cloth W and for automatically adjusting the tension of needle thread NT by thread tension adjustment mechanism 12 so that appropriate thread tension or balance in tension is obtained. More specifically, as can be seen in FIG. 2, a first camera 39 and a second camera 40 are provided which are each configured by a CMOS (Complementary Metal Oxide Silicon) image sensor of approximately 2 million pixels. The first camera 39 is provided at the bottom interior of head 5 so as to be oriented downward and situated behind presser bar 8. Thus, images of stitches formed on workpiece cloth W are captured from the upper surface, in other words, the top surface side immediately after they are formed by needle bar 6 and rotary shuttle mechanism 23.

The second camera 40 is provided at the rear portion of needle plate 20 placed on the upper portion of sewing machine bed 2 so as to be oriented upward to oppose the first camera 39. Thus, images of stitches formed on workpiece cloth W are captured from the underside, in other words, the lower surface side immediately after they are formed by needle bar 6 and rotary shuttle mechanism 23. As shown in FIG. 5, the image data captured by the first and the second cameras 39 and 40 is inputted to controller 41.

FIG. 5 schematically indicates the electrical configuration of the sewing machine according to the present exemplary embodiment mainly focusing on controller 41 responsible for the overall control of sewing machine body 1.

Controller 41 is configured primarily by a microcomputer which establishes connections with components such as CPU 42, ROM 43, RAM 44, EEPROM 45, input interface 46, and output interface 47 which are interconnected by an interconnect such as a bus 48. ROM 42 stores programs such as a control program for controlling a sewing operation and a later described thread tension adjustment program as well as various data such as stitch data required in the sewing operation and modification data indicated in FIG. 14 for modifying thread tension or the tension balance.

Input interface 46 of controller 41 establishes connections with various key switches 17 including start/stop key 17*a* and touch panel 19 and receive their operation signals. Input interface 46 is further connected to main shaft angle detector 16 to receive input of its detection signals. Further, as described above, input interface 46 is connected to the first camera 39 and the second camera 40 and receive the image data captured by them.

Output interface 47 of controller 41 is connected to LCD 18 through drive circuit 49 and serves as a display controller for controlling the display of LCD 18. Output interface 47 further establishes connections with pulse motor 33, pulse motor 29, sewing machine motor 13, pulse motor 15 through drive circuits 50, 51, 52, and 53. Controller 41 executes the sewing operation through control of these components.

As will be later described in the operation of the present exemplary embodiment by way of a flowchart, controller 41 evaluates the tension balance which is a balance in the tension between needle thread NT and bobbin thread BT of the stitches formed on workpiece cloth W to obtain a suitable tension balance. The thread tension adjustment program may be provided by an external source through storage medium such as an optical disc, magnetic disc, including but not limited to a card type of stick type compact memory.

More specifically, first, an image capturing routine is executed in which image data of stitches captured from the upper and the undersides of workpiece cloth W by the first and the second cameras 39 and 40 are taken in respectively. Next, based upon the image data of stitches taken in from the top and undersides of workpiece cloth W, an extraction routine in which the area of opposite side thread appearing at interlace S of needle thread NT and bobbin thread BT is executed by image processing. Then, a calculation routine is executed in which the area of the extracted region occupied by the threads is calculated. In the present exemplary embodiment, the calculation of the area is carried out by counting the pixels of the extracted region occupied by the threads, that is, needle thread NT and bobbin thread BT.

Figure 7A:
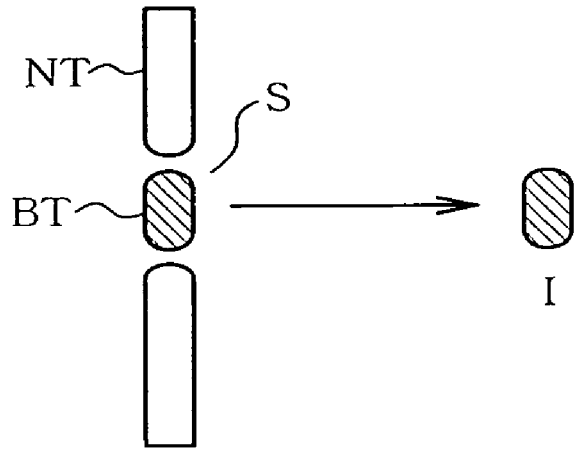
FIG. 7A depicts a stitch being formed on an upper side of a workpiece cloth and an extracted area of thread.
Figure 7B:
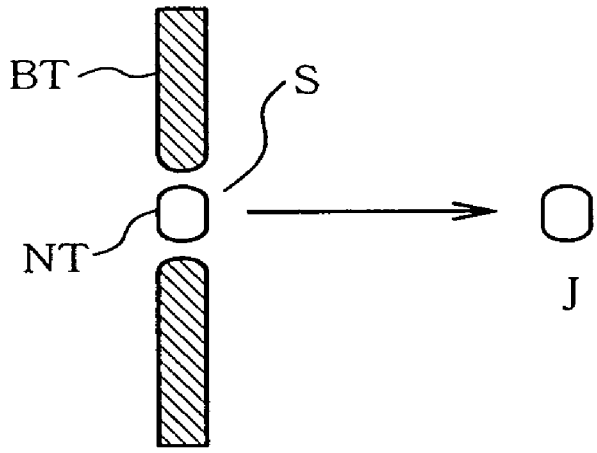
FIG. 7B depicts a stitch being formed on an underside of a workpiece cloth and an extracted area of thread.

FIG. 6 schematically describes the cross sections of stitches formed on workpiece cloth W by sewing machine body 1. The stitches are formed by interlacing needle thread NT residing on the surface side or top side of workpiece cloth W with bobbin thread BT residing on the underside or the back side of workpiece cloth W at interlace S. At interlace S, bobbin thread BT appears on the upper side of workpiece cloth W As shown in FIG. 7A, whereas needle thread NT appears on the underside of workpiece cloth W as shown in FIG. 7B. The present exemplary embodiment is explained through an example in which needle thread NT and bobbin thread BT differ in thread color. Bobbin thread BT is represented by hatches in FIGS. 6A, 6B, 6C, 7A and 7B to reflect such difference in thread color.

Thus, when forming stitches on the upper side of workpiece cloth W with needle thread NT, the opposite side thread, in other words, the counterpart thread that appears at interlace S indicates bobbin thread BT. As shown in FIG. 7A, the region occupied or covered by bobbin thread BT appearing at interlace S is extracted based on the image data of the upper side of workpiece cloth W captured by the first camera 39 to calculate area I. When stitches are formed with bobbin thread BT on the underside of workpiece cloth W, on the other hand, opposite side thread indicates needle thread NT. As shown in FIG. 7B, the region occupied or covered by needle thread NT appearing at interlace S is extracted based on the image data of the underside of workpiece cloth W captured by the second camera 39 to calculate area J.

Then, based on areas I and J calculated by the above described calculation routine, evaluation routine is executed to evaluate the tension balance. In the present exemplary embodiment, the evaluation of tension balance is carried out by comparing area I of bobbin thread BT appearing at interlace S on the upper side of workpiece cloth W and area J of needle thread NT appearing at interlace S on the underside of workpiece cloth W to obtain thread tension rate K which is calculated by K=J/I. If area I and area J are substantially equal with only a permissible difference, tension balance is evaluated to be appropriate. If area I is greater than area J in excess of the permissible difference, an evaluation is made to determine that needle thread NT has relatively greater tension (needle thread intensive). In contrast, if area J is greater than area I in excess of the permissible difference, an evaluation is made to determine that bobbin thread BT has greater tension (bobbin thread intensive).

Finally, based on the evaluation, in other words, thread tension rate K, pulse motor 33 of thread tension adjustment mechanism 12 is controlled to execute a modification routine that modifies the thread tension of needle thread NT to obtain suitable tension balance. The modification, as shown in FIG. 14 is performed by looking up a pre-stored modification data table and driving pulse motor 33 by a modification amount, that is, number of pulses that corresponds to the obtained thread tension rate K. If thread tension rate K is less than the permissible range, modification is made to reduce the tension of needle thread NT whereas if thread tension rate K is greater than the permissible range, correction is made to increase the tension of needle thread NT.

Next, the operation of sewing machine body 1 according to the above described configuration will be described with reference to FIGS. 8 to 14. In the present exemplary embodiment, when sewing operation is executed on workpiece cloth W, evaluation of tension balance and automatic adjustment in tension of needle thread NT is performed throughout the duration of sewing operation. Further, stitches are formed on a white workpiece cloth W with needle thread NT and bobbin thread BT differing in thread color. To elaborate, a blue color thread is used for needle thread NT and a red color thread is used for bobbin thread BT, for example.

The flowchart given in FIG. 8 indicates the overall process flow of evaluation and automatic adjustment in thread tension/tension balance executed by controller 41 through thread tension adjustment program described above. Flowchart given in FIG. 9 indicates the process flow of thread tension rate evaluation process executed at step S3 of FIG. 8 and flowcharts given in FIGS. 10, 11, and 12 describe further details of steps S12, S14, and S15 of FIG. 9, respectively. The flowchart given in FIG. 13 indicates the process flow of the drive process of pulse motor 33 at step S4 of FIG. 8.

As the initial step in the process flow indicated by the flowchart given in FIG. 8, a determination is made as to whether or not the sewing operation is ongoing, in other words, whether or not the main shaft is driven in rotation by sewing machine motor 13 at step S1. If the sewing operation is ongoing (step S1: Yes), a determination is made at subsequent step S2 as to whether or not a lowered needle detection signal has been detected, in other words, whether or not sewing needle 7 is in a lowered position to penetrate workpiece cloth W, based on the detection signal of main shaft angle detector 16. If a lowered needle detection signal has been detected (step S2: Yes), a determination is made that workpiece cloth W rests motionless upon needle plate 20 without being fed by feed dog drive mechanism 24, and the process proceeds to step S3. At step S3, evaluation of tension balance, in other words, thread tension K is calculated. The evaluation of thread tension is carried out according to the steps indicated in FIG. 9.

Before going into further details, a description will be given on the basic principles of thread tension evaluation performed in the present exemplary embodiment. FIGS. 6A to 6C schematically show the cross sections of stitches formed on workpiece cloth W by sewing machine 1. Stitches are formed by interlacing needle thread NT residing at the upper side and bobbin thread BT residing at the underside of workpiece cloth W respectively. If tension of needle thread NT and bobbin thread BT are well balanced, the point of interlace of the two threads sits at the vertical mid portion of the thickness of workpiece cloth W as shown in FIG. 6A. As opposed to this, if tension of needle thread NT is greater than the appropriate value, the point of interlace of needle thread NT and bobbin thread BT sits on the upper side of workpiece cloth W as shown in FIG. 6B. At this instance, when the stitch is viewed from the top of workpiece cloth W, bobbin thread BT, in other words, the opposite side thread covers relatively greater region or area at interlace S.

Similarly, when the tension of needle thread NT is less than the appropriate value, in other words, the tension of bobbin thread BT is relatively greater, the point of interlace of needle thread NT and bobbin thread BT sits on the under side of workpiece cloth w as shown in FIG. 6C. At this instance, when the stitch is viewed from the top of workpiece cloth W, bobbin thread BT or the opposite side thread does not appear at all or is hardly visible at interlace S, whereas when viewed from the underside of workpiece cloth W, needle thread NT or the opposite side thread covers relatively greater region or area at interlace S. Thus, tension balance can be evaluated through the notion that visibility of needle thread NT and bobbin thread BT at interlace S at both upper and undersides of workpiece cloth W differs depending upon the balance in thread tension.

Figure 9:
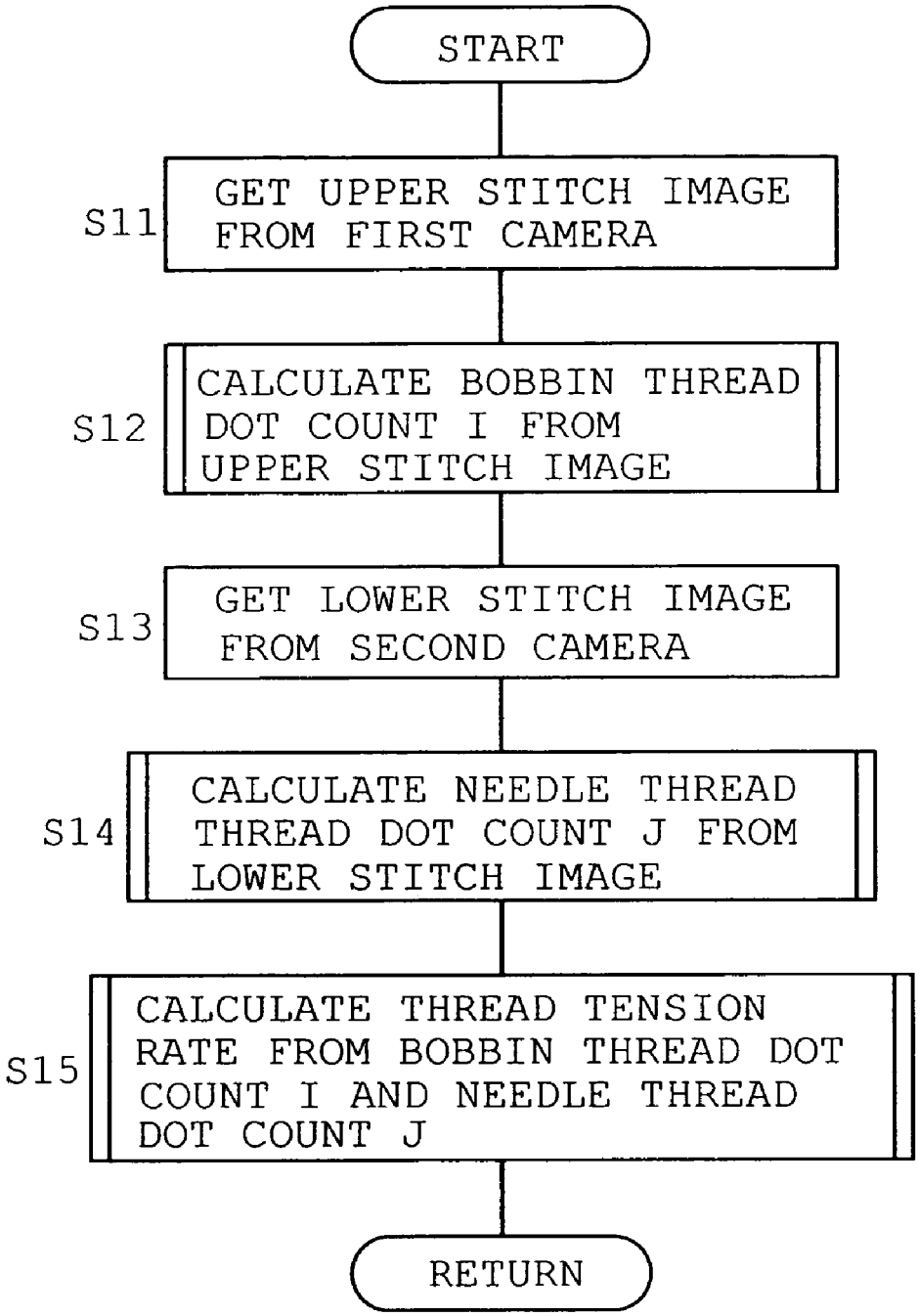
FIG. 9 is a flowchart indicating the process flow of thread tension evaluation of step S3 of the flowchart given in FIG. 8.

At step S11 of FIG. 9, the image of stitches formed on the upper side of workpiece cloth W is captured by the first camera 39 as shown in FIG. 7A and the captured image data referred to as the upper stitch image is taken in as input. At step S12, the region occupied by bobbin thread BT appearing at a single interlace S is extracted from the upper stitch image and area I of the region is calculated, in this case, by counting the dots. The flowchart given in FIG. 10 describes the process of the above described step S12 in more detail.

Figure 10:
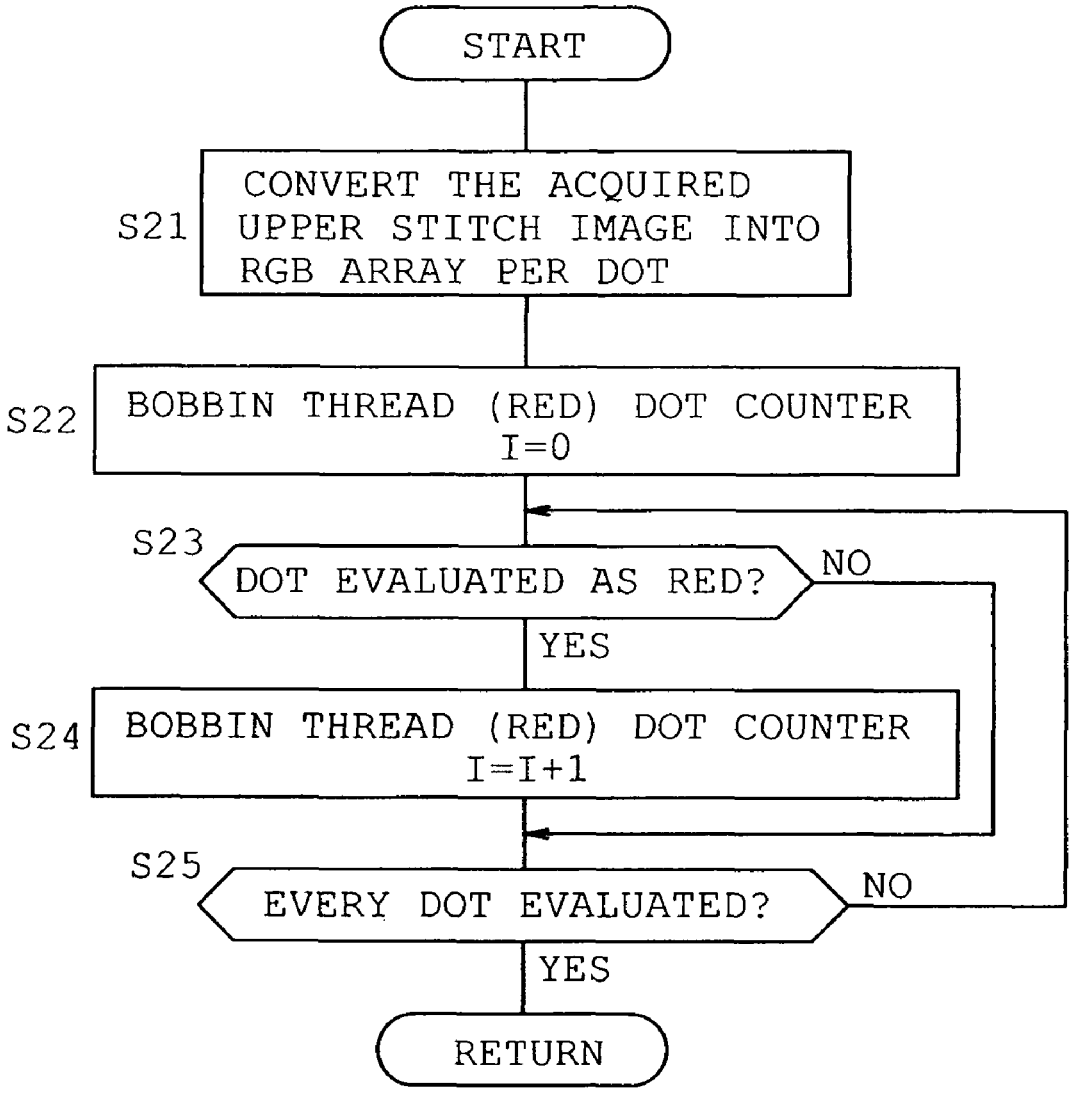
FIG. 10 is a flowchart detailing step S12 of flowchart given in FIG. 9.

At step S21 of the flowchart given in FIG. 10, each of the dots of the obtained data from the upper stitch image is converted into RGB (Red, Green, and Blue) array corresponding to each dot. Each dot is assigned a value ranging from 0 to 255 for each of RGB. At step S22, zero is set at bobbin thread (red) dot counter I. Then, at step S23, a determination is made dot by dot as to whether or not a given dot is a red dot. The determination is carried out by threshold filtering so that a given dot is determined as a red dot if, for instance, the "R" value is 100 or greater, and both "B" and "G" values are 99 or less.

In case a dot is determined as a red dot (step S23: YES), the process proceeds to step S24 and bobbin thread (red) dot counter I is incremented by 1. If the dot is determined not to be a red dot (step S23: NO), the process proceeds to step S25. At step S25, a determination is made as to whether or not red color determination has been completed for all of the dots and if not completed (step S25: No), the process returns to step S23. If the red color determination has been completed for all of the dots (step S25: YES), the process is terminated and control flow returns to the flowchart given in FIG. 9. The process indicated in the flowchart given in FIG. 10 calculates the dots as area I of the region of bobbin thread BT appearing at interlace S on the upper side of workpiece cloth W.

Figure 11:
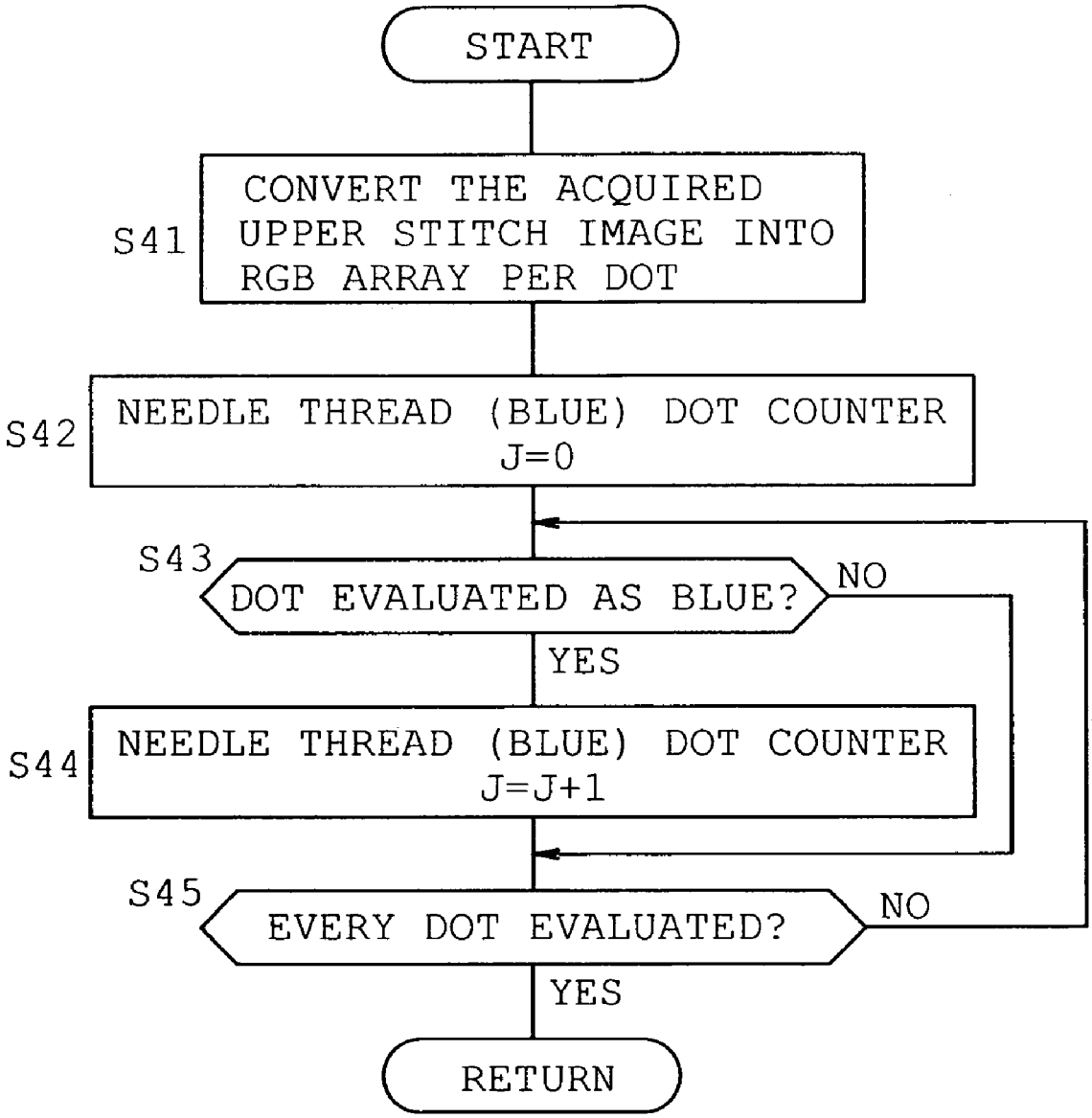
FIG. 11 is a flowchart detailing step S14 of flowchart given in FIG. 9.
Figure 12:
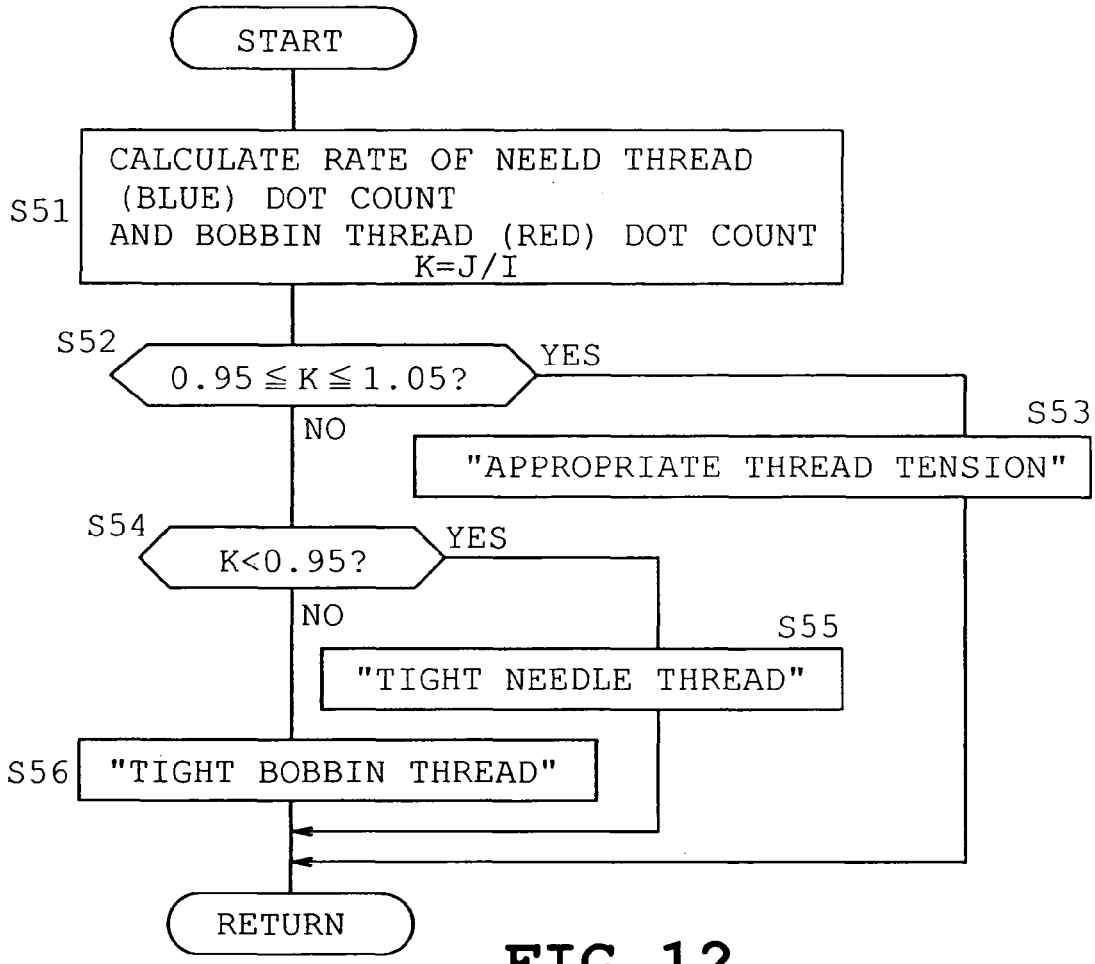
FIG. 12 is a flowchart detailing step S15 of flowchart given in FIG. 9.
Figure 13:
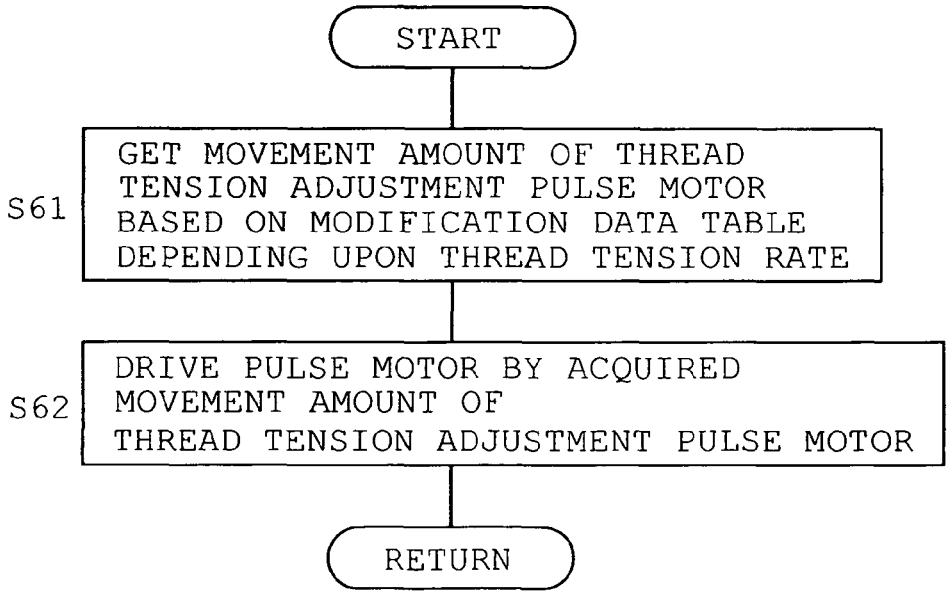
FIG. 13 is a flowchart indicating the process flow of the thread tension adjustment of step S4 of the flowchart given in FIG. 8.

Thereafter, the control flow returns to FIG. 9 and at step S13, the second camera 41 captures the images of the stitches formed on the underside of workpiece cloth W as shown in FIG. 7B, and the image data is taken in as a lower stitch image. At step 14, the region occupied by needle thread NT appearing at interlace S is extracted from the lower stitch image and the process for calculating area J of such region, in this case, by counting the number of dots as can be seen in FIG. 11. At step S41 of the flowchart given in FIG. 11, each of the dots contained in the obtained data from the lower stitch image is converted into RGB (Red, Green, and Blue) array. At step S42, zero is set at needle thread (blue) dot counter J. Then, at step S43, a determination is made dot by dot as to whether or not a given dot is a blue dot.

In case a dot is determined as a blue dot (step S43: YES), the process proceeds to step S44 and needle thread (blue) dot counter J is incremented by 1. If the dot is determined not to be a blue dot (step S43: NO), the process proceeds to step S45. At step S45, a determination is made as to whether or not the blue color determination has been completed for all of the dots and if not completed (Step S45: No), the process returns to step S43. If the blue color determination has been completed for all of the dots (step S45: YES), the process is terminated and control flow returns to the flowchart given in FIG. 9. The process indicated in the flowchart given in FIG. 11 calculates the count of dots as area J of the region of needle thread NT appearing at interlace S on the underside of workpiece cloth W.

Then, the process returns to the flowchart given in FIG. 9, and at the subsequent step S15, a process for evaluating the tension balance, that is, the calculation of thread tension rate K is executed from bobbin thread dot count I and needle thread dot count J calculated as described above. The flowchart given in FIG. 12 describes the specific details of the process. At step S51 of the flowchart given in FIG. 12, thread tension rate K indicating the ratio of needle thread dot count I and bobbin thread dot count J are calculated. Then at step S52, a determination is made as to whether thread tension rate K is within the range of 0.95 or greater and 1.05 or lower, in other words, whether or not needle thread dot count I and bobbin thread dot count J are substantially equal. If thread tension rate K is within the above described range (step S52: YES), an evaluation is made that tension of needle thread NT and bobbin thread BT are well balanced as shown in FIG. 6A, meaning that tension balance is appropriate (step S53: YES).

As opposed to this, if thread tension rate K is outside the above described range of 0.95 or greater and 1.05 or lower (step S52: NO), determination is made at step S54 as to whether or not thread tension rate K is less than 0.95. If thread tension rate K is less than 0.95 (step S54: YES), an evaluation is made that bobbin thread dot count I is relatively greater, meaning that greater tension is exerted on needle thread NT as shown in FIG. 6B (step S55). If thread tension rate K is greater than 1.05 (step S54: NO), an evaluation is made that bobbin thread dot count I is relatively less, meaning that greater tension is exerted on bobbin thread BT as shown in FIG. 6C (step S56).

When thread tension evaluation indicated in the flowchart given in FIG. 9 executed at step S3 of the flowchart given in FIG. 8 is completed, the process flow returns to the flowchart given in FIG. 8 and proceeds to step S4 in which positioning of pulse motor 33 of thread tension adjustment mechanism 12 is modified, in other words, adjustment is made on the tension balance. As detailed in the flowchart given in FIG. 13, first, at step S61, amount of movement, in other words, count of pulse of pulse motor 33 corresponding to thread tension rate K is obtained by looking up modification data table given in FIG. 14. Then, at step S62, pulse motor 33 is driven by the count of pulses corresponding to the amount of movement.

As shown in FIG. 14, thread tension rate K being equal to or greater than 0.95 and equal to or less than 1.05 provides appropriate tension balance in which case the count of pulse indicating the amount of modification amounts to zero. If thread tension rate is equal to or less than 0.94, the count of pulse indicating the amount of modification takes a negative value to reduce the tension of needle thread NT and the amount of negative modification or count of negative pulse increases as thread tension rate becomes smaller. If thread tension rate is equal to or greater than 1.06, the count of pulse indicating the amount of modification takes a positive value to increase the tension of needle thread NT and the amount of positive modification or count of positive pulse increases as thread tension rate K becomes greater.

As described above, when the tension balance does not fall within the range of appropriate tension balance, the thread tension of needle thread NT is modified so that the tension balance falls within the range of tension balance by thread tension adjustment mechanism 12. When the process indicated in the flowchart given in FIG. 14 executed at step S4 of the flowchart given in FIG. 8 is completed, workpiece cloth W is fed by feed dog drive mechanism 24 at step S5 of the flowchart given in FIG. 8. Then the control flow returns to step S1 and repeats evaluation of tension balance and adjustment of tension balance to allow the sewing operation to be executed under the appropriate tension balance.

In the above described exemplary embodiment, evaluation of balance in thread tension has been carried out by utilizing the fact that the area of region occupied by the opposite side thread at interlace S varies depending on the balance in the tension of needle thread NT and bobbin thread BT. According to the present exemplary embodiment, images of stitches formed on workpiece cloth W is captured by the first camera 39 and the second camera 40 provided at sewing machine body 1, and region occupied by the opposite side thread appearing at interlace S is extracted based upon which the area of the extracted region is calculated to evaluate the tension balance with reliability. The above described configuration does not rely on subjective discretion of the user but instead, automatically evaluates the tension balance based upon the region and consequently the area occupied by the thread extracted and calculated from the captured image data of stitches. Unlike the configuration in which the tension balance is evaluated by detecting the contours of the thread or the depth of interlace by a reflection detector, the approach described in the present exemplary embodiment is not affected by ambient light nor the color and material of workpiece cloth W.

Thus, the thread tension, in other words tension balance can be evaluated and adjusted automatically and at the same time the reliability of the evaluation can be sufficiently improved to provide advantageous thread tension adjustment capabilities. The present exemplary embodiment is particularly advantageous in that the tension balance is evaluated by capturing the image of the stitch from both the upper and undersides of workpiece cloth W by the first camera 39 and the second camera 40, counting the pixels I and J of the region occupied by the opposite side thread appearing at interlace S of both upper and undersides of workpiece cloth W based on the captured images, and comparing the counted pixels I and J to evaluate the tension balance. Thus, the tension balance can be evaluated precisely in a relatively simple configuration. The present exemplary embodiment is further advantageous in that the tension balance can be readily adjusted through a simple control of pulse motor 33 of thread tension adjustment mechanism 12.

Figure 15:
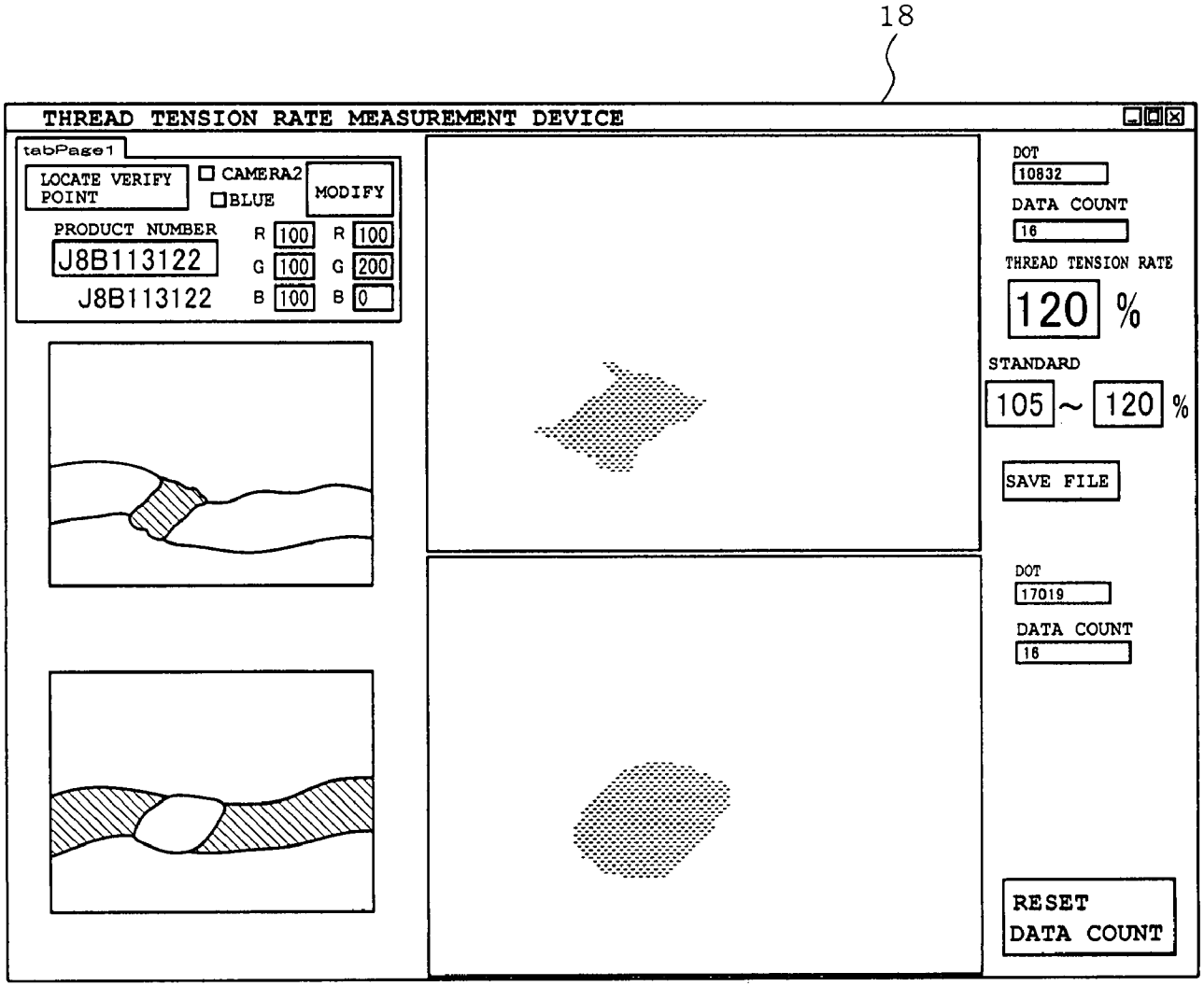
FIG. 15 shows an example of a screen indicating the result of thread tension evaluation displayed on a display unit according to a second exemplary embodiment of the present disclosure.

FIG. 15 depicts a second exemplary embodiment of the present disclosure and shows one example of display on LCD 18. In the second exemplary embodiment, when evaluating tension balance at step S3 of FIG. 8, the above described result of thread tension evaluation and the images captured by the first camera 39 and the second camera 40 are displayed on LCD 18. The display on LCD 18 is controlled by controller 41.

On the screen displayed at LCD 18, thread tension rate K representing the result of tension balance evaluation is indicated in percentage, in this case, at 120% in the rightmost column of the screen shown in the drawings. At the same time, bobbin thread dot count I is displayed on the upper portion and needle thread dot count J is shown in the lower portion. The images captured by the first camera 39 and the second camera 40 are displayed on upper left side column and the lower left side column of the screen respectively. Further, in the upper central column, the regions occupied by bobbin thread BT and needle thread NT on interlace S extracted from the captured images are displayed. The above described screen arrangement noticeably brings to the attention of the user that thread tension or tension balance evaluation is ongoing as well as presenting the result of the evaluation in a clear and concise manner.

Next, a description will be given on a third exemplary embodiment with reference to FIGS. 16 to 19. The flowcharts given in FIGS. 6, 7, 10, 11, and 12 of the first exemplary embodiment are also applicable to the third exemplary embodiment, and thus will not be reproduced but instead reference will be made to the second exemplary embodiment as well by using identical reference symbols/step numbers.

Thread tension evaluation unit 61 of the third exemplary embodiment makes adjustments in tension balance, in other words, in making adjustments in the balance of tension between needle thread NT and bobbin thread BT but is provided as a unit independent of the sewing machine. That is, in the present exemplary embodiment, test stitches are formed on workpiece cloth W by the sewing machine, whereafter the test stitches formed on workpiece cloth W are evaluated by thread tension evaluator 61.

Figure 16:
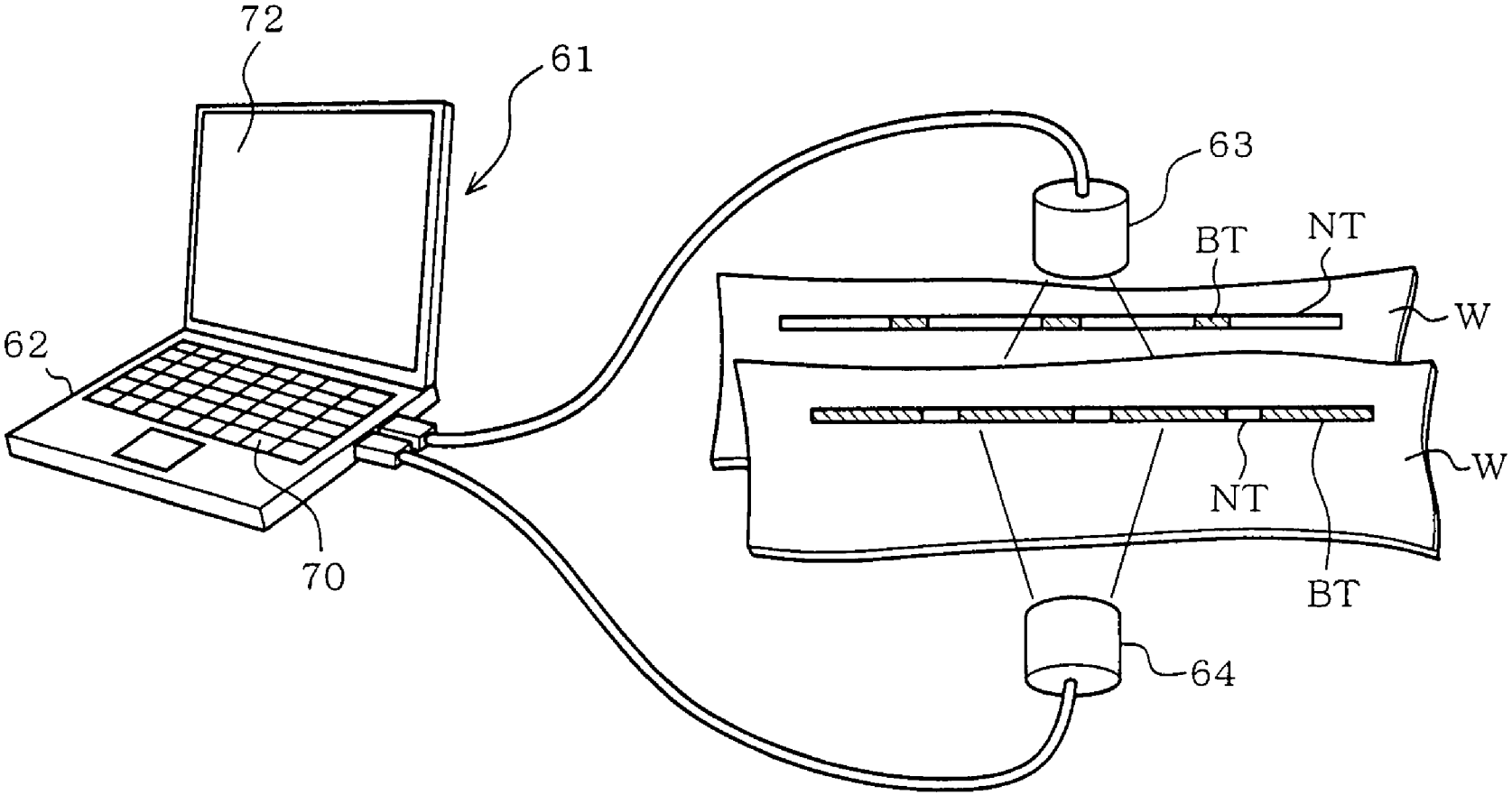
FIG. 16 shows an external configuration of a thread tension evaluation unit according to a third exemplary embodiment.

Though not shown, in the present exemplary embodiment, the sewing machine is provided with mechanisms such as a feed mechanism and a stitching mechanism. When a sewing operation is executed by the sewing machine, stitches are formed on workpiece cloth W by interlacing needle thread NT and bobbin thread BT as shown in FIG. 16. Test stitches are formed, for instance, on a white workpiece cloth W with needle thread NT and bobbin thread BT of different colors with the former being sewn in blue thread and the later being sewn in red thread. Such difference in the color of needle thread NT and bobbin thread BT is represented by hatching the bobbin thread BT in FIGS. 16 and 18.

The sewing machine has an arm provided with a thread tension unit that applies thread tension on needle thread NT. A rotary shuttle, more specifically, the inner shuttle is provided with a tension applier that applies a predetermined and fixed thread tension on bobbin thread BT. As known, the above described thread tension unit includes a thread tension shaft secured on a sewing machine main frame, a pair of thread tension discs penetrated by the thread tension shaft, a coil spring that exerts spring force acting as clamping force on the thread tension discs, and a thread tension dial that, when turned, makes adjustments in the spring force of the coil spring. Needle thread drawn form the thread spool serving as the source of supply of needle thread NT, is passed between the pair of thread tension discs to be thereafter passed through components such as a thread take-up and thereafter through the eye of the sewing needle. By turning the thread tension dial, the user is allowed to make adjustments in thread tension of needle thread NT and consequently the balance of tension between needle thread NT and bobbin thread BT.

Next, a description will be given on needle thread tension evaluation unit 61 of the present exemplary embodiment. As shown in FIG. 16, thread tension evaluation unit 61 of the second exemplary embodiment includes a computer. To elaborate, evaluation unit body 62 configured by a laptop PC readily available in the market is connected to a couple of first and second cameras 63 and 64.

Figure 17:
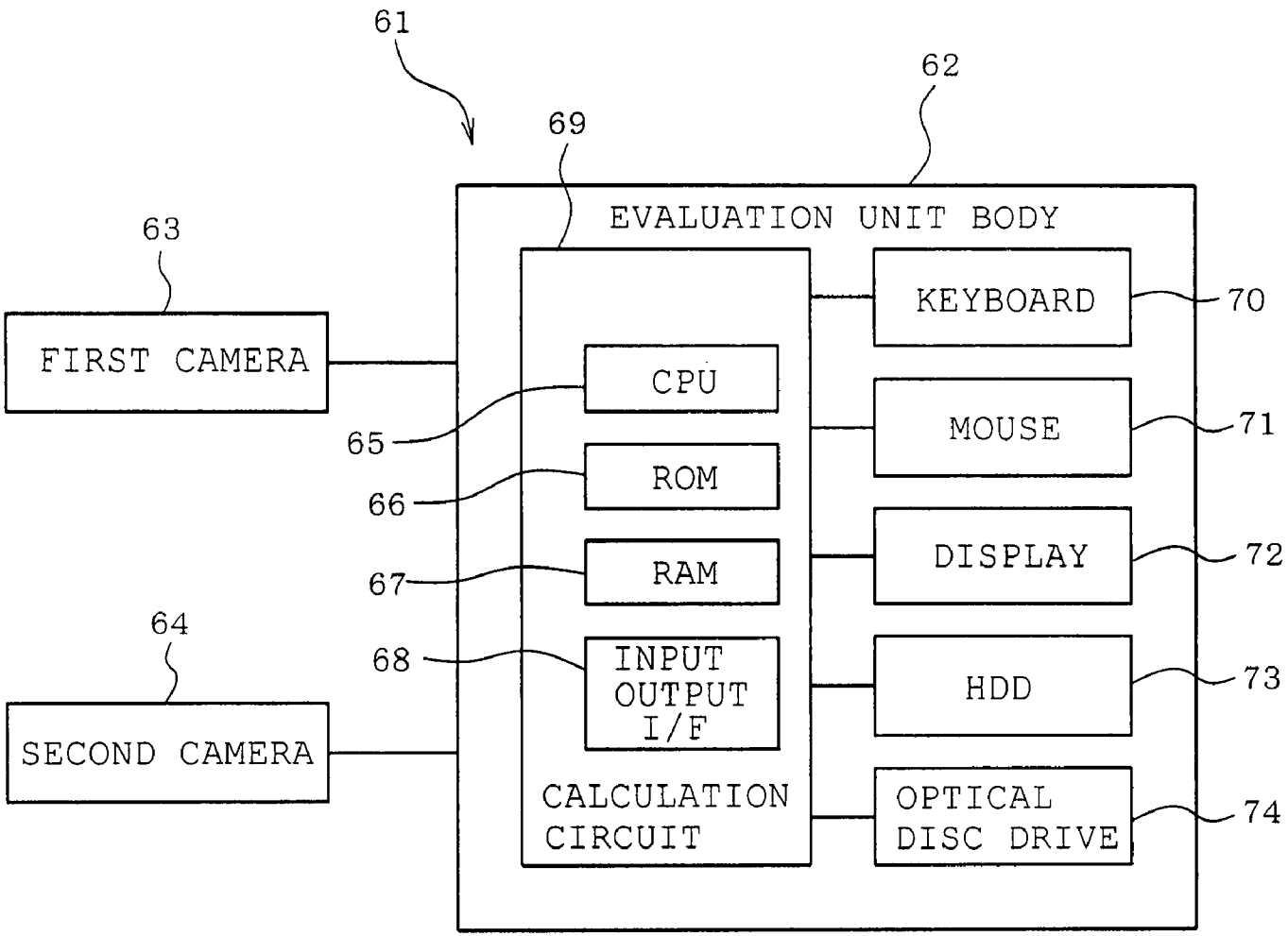
FIG. 17 is a block diagram indicating an electrical configuration of the thread tension evaluation unit.

As shown in FIG. 17, evaluation unit body 62 is provided with a calculation circuit 69 comprising components such as CPU 65, ROM 66, RAM 67, and input/output interface 68. Calculation circuit 69 further establishes connections with components such as keyboard 70, mouse 71, display 72, hard disc unit 73, and optical disc drive 74 that reads data from and writes data to medium such as CD (Compact Disc) and DVD (Digital Versatile Disc). As will be later described, a thread tension evaluation program is pre-stored, for example, in hard disc unit 73, or stored in computer readable medium such as CD and DVD so that it can be loaded from such medium set to optical disc drive 74.

The first and the second cameras 63 and 64 are both configured by cameras known as a USB camera that comprises a CMOS (Complimentary Metal Oxide Semiconductor) camera with a resolution of 2 million pixels, for example. The USB cameras can be connected directly to evaluation unit body 62 without a driver through a USB (Universal Serial Bus) connector. As can be seen in FIG. 16, the first camera 63 captures the images of the stitches formed on workpiece cloth W from the upper side of workpiece cloth W. The second camera 64 captures the images of the stitches formed on workpiece cloth W from the underside of workpiece cloth W. The image data captured by these cameras 63 and 64 are inputted to calculation circuit 69 of evaluation unit body 62 to be subjected to further processing.

Evaluation unit body 62, more specifically, calculation circuit 69 executes, through execution of the thread tension adjustment program, the processes required in evaluating the tension balance, that is, the balance in the tension between needle thread NT and bobbin thread BT of the test stitches formed on workpiece cloth W by the user using the sewing machine. As later described in the operation of the process flow by way of flowchart, the user is to set workpiece cloth W at a predetermined position that would allow images of workpiece cloth W to be captured from both the upper and undersides by the first camera 63 and the second camera 64. Then, keyboard 70 and/or mouse 71 is operated to instruct the process start time. Thus, calculation circuit 69 automatically executes the following processing routine.

First, an image input routine is executed to take in the image data of the stitches captured by the first and the second cameras 63 and 64 from both the upper and undersides of workpiece cloth W. Then, based on the image data of the stitches captured from both upper and undersides of workpiece cloth W that have been taken in, an extraction routine is executed to extract, by image processing, the region occupied by the opposite side thread appearing at interlace S of needle thread NT and bobbin thread BT. Then, a calculation routine is executed to calculate the area of the extracted region occupied by the threads. The calculation of the area is carried out, for example, by counting the number of pixels within the extracted region occupied by the threads.

Then, as described in FIGS. 6A to 6C, and 7A and 7B of the first exemplary embodiment, bobbin thread BT of interlace S appears at the upper surface of workpiece cloth W, whereas needle thread NT appears on the underside of workpiece cloth W. In the calculation routine, the region occupied by bobbin thread BT appearing at interlace S is extracted from the image data of the upper side of workpiece cloth W captured by the first camera 63 to calculate area I. Similarly, the region occupied by needle thread NT appearing on interlace S is extracted from the image data of the underside of workpiece cloth W captured by the second camera 64 to calculate area J.

Then, based on the calculated areas I and J, the evaluation routine is executed to evaluate the thread tension, in other words, tension balance. The evaluation of tension balance is carried out by comparing area I of bobbin thread BT appearing on the upper side interlace S and area J of needle thread NT appearing on the underside interlace S. Finally, a routine is executed to output the result of evaluation. In this case, the result of evaluation is presented to display 72 of evaluation unit body 62 as shown, for example, in FIG. 18 in which the thread tension rate is indicated by percentage. Display 72 further displays the images captured by the first camera 63 and the second camera 64 in addition to the result of evaluation.

Next, a description will be given on the operation of thread tension evaluation unit 61 of the present exemplary embodiment being configured as described above. The flowchart given in FIG. 19 indicates the overall process flow of the thread tension evaluation process executed by thread tension evaluation unit 61. Steps S61 to S65 of the flowchart given in FIG. 19 are the same as steps S11 to S15 of the flowchart given in FIG. 9 of the first exemplary embodiment, and thus will only be briefly described.

As described earlier, in executing the thread tension evaluation, the user is to apply, for instance, a blue color needle thread NT and a red color bobbin thread BT to form test stitches on a white workpiece cloth W. Then, workpiece cloth W having test switches sewn on it is set to a predetermined position of thread tension evaluation unit 61 as a preparatory step for locating workpiece cloth W to a positioned allowing its images to be captured by cameras 63 and 64. Then, the thread tension evaluation program is executed to start the thread tension evaluation.

Figure 19:
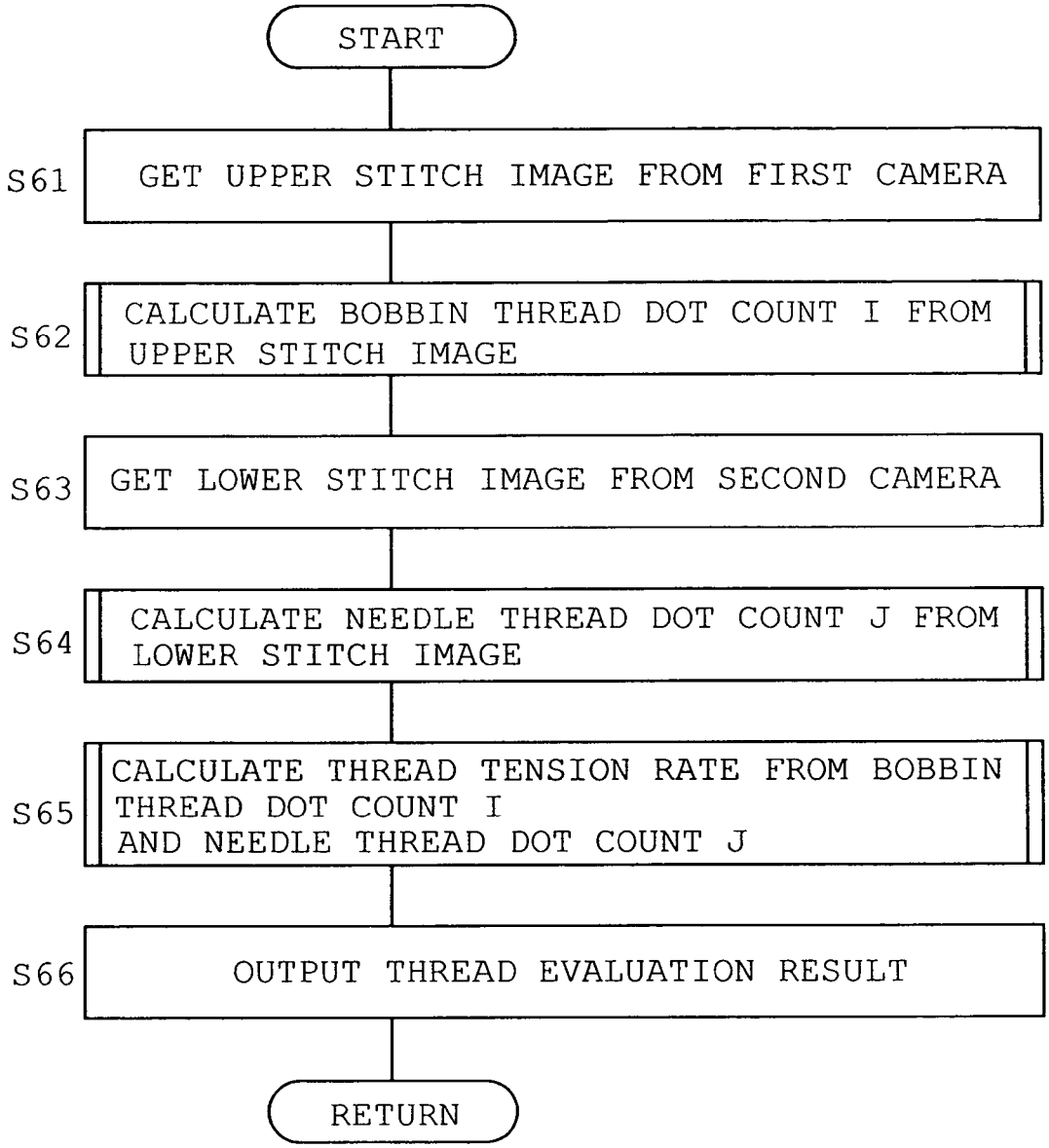
FIG. 19 is a flowchart indicating the entire process flow of thread tension evaluation executed by a calculation circuit.

First, at step S61 of FIG. 19, the image of the stitch on the upper side of workpiece cloth W is captured by the first camera 63 and the captured image data, in other words, the upper stitch image is taken in. At step S62, the region occupied by bobbin thread BT appearing on a single interlace S is extracted from the upper stitch image and a calculation process is executed to calculate area I of the region by counting the dots. The details of the calculation process will not be described since it is the same as the process flow indicated by the flowchart given in FIG. 10 of the first exemplary embodiment.

At step S63, the second camera 64 captures the image of the stitch formed on the underside of workpiece cloth W and the captured image, that is, the lower stitch image is taken in. At step S64, the region occupied by needle thread NT appearing at a single interlace S is extracted from the lower stitch image and a process for calculating area J or the count of dots of the extracted region is executed. The details of these processes will not be described since they are the same as those indicated in the flowchart given in FIG. 11 of the first exemplary embodiment.

Figure 18:
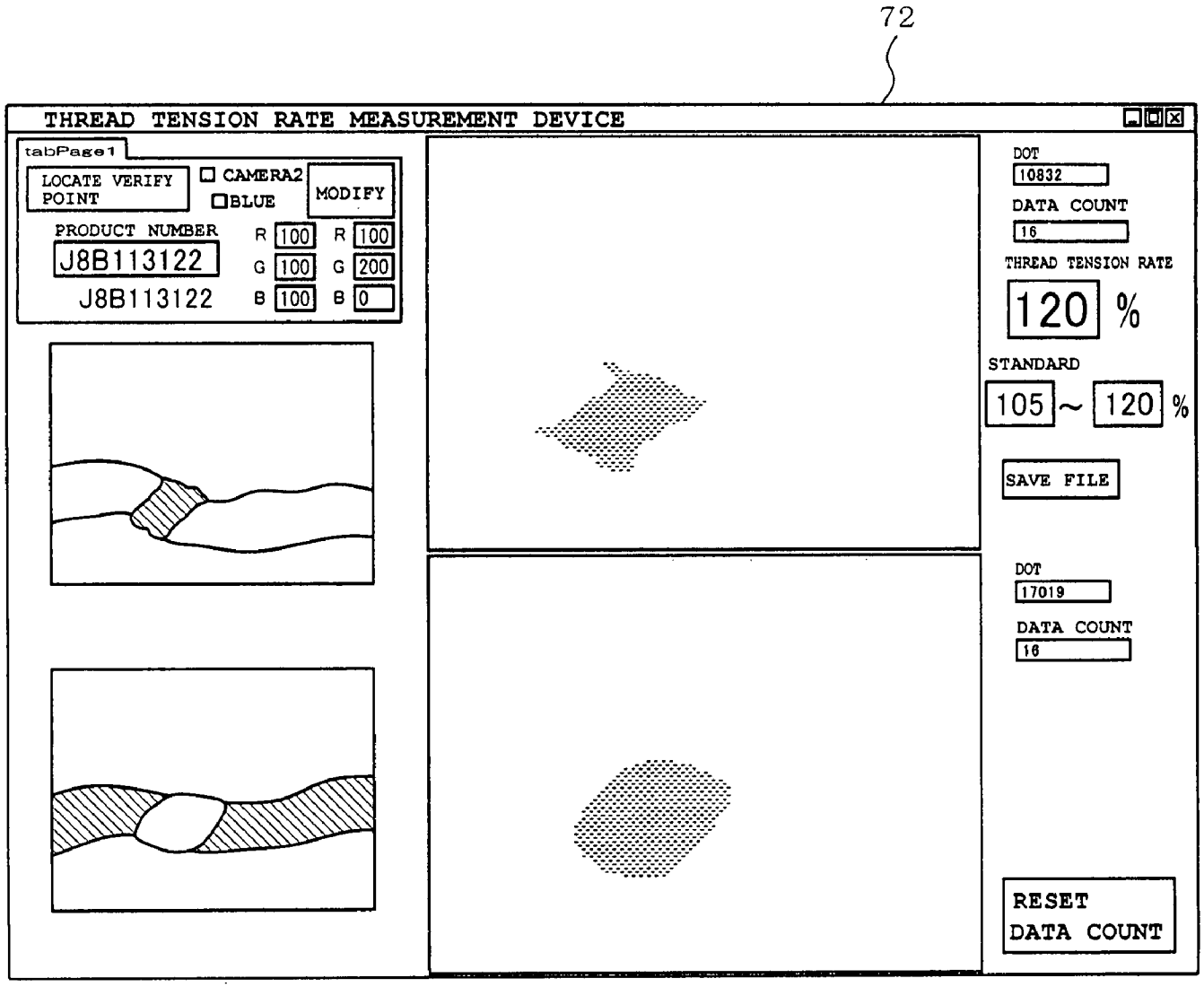
FIG. 18 shows an example of a screen indicating the result of thread tension evaluation displayed on a display unit.

Then, at step S65, based on bobbin thread dot count I and needle thread dot count J calculated according to the above described steps, evaluation of tension balance, in this case, calculation of thread tension rate is executed. Details of the process flows for these processes will also not be given since they are the same as those indicated in the flowchart given in FIG. 12. When the evaluation of tension balance is completed, the result of evaluation of tension balance is presented on display 32 at step S66. FIG. 18 is an example of a screen presented on display 72 for presenting the result of evaluation of tension balance.

In the rightmost column of display 72, thread tension rate K representing the result of thread tension evaluation is indicated in percentage, in this case, at 120%. At the same time, bobbin thread dot count I is displayed on the upper portion and needle thread dot count J is shown in the lower portion. The images captured by the first camera 63 and the second camera 64 are displayed on upper left side column and the lower left side column of the screen respectively. Further, in the central column, the regions occupied by bobbin thread BT and needle thread NT at interlace S extracted by the capture images are displayed.

Based on the result of evaluation shown in display 72, the user is allowed to make adjustments in the tension of needle thread NT, that is, the balance in thread tension between needle thread NT and bobbin thread BT by turning the thread tension dial provided at the thread tension unit of the sewing machine. Further, after making adjustments in the tension balance with the thread tension unit, test switches can be formed again to allow the user to repeat the above described steps until obtaining an evaluation that appropriate thread tension or tension balance has been obtained. Thereafter, the user can perform the sewing operation with proper tension balance.

According to the present exemplary embodiment, images of stitches formed on workpiece cloth W is captured by the first camera 63 and the second camera 64, and the region occupied by the opposite side thread appearing at interlace S is extracted based upon which the area of the region occupied by the thread is calculated to evaluate the tension balance with reliability. The above described configuration does not rely on subjective discretion of the user but instead, automatically evaluates the tension balance based on the regions and consequently the areas of threads extracted and calculated from the captured image data of the stitches. Unlike the configuration in which tension balance is evaluated by detecting the contours of the thread or the depth of interlace by a reflection detector, the approach described in the present exemplary embodiment is not affected by ambient light nor the color and material of workpiece cloth W.

Thus, tension balance can be evaluated and adjusted automatically and at the same time reliability of the evaluation can be sufficiently improved to provide advantageous thread tension/tension balance adjustment capabilities. The present exemplary embodiment is particularly advantageous in that the tension balance is evaluated by capturing the images of the stitch from both the upper and undersides of workpiece cloth W by the first camera 63 and the second camera 64, counting the pixels I and J of the region occupied by the opposite side thread appearing at interlace S of both upper and undersides of workpiece cloth W based on the captured images, and comparing the counted pixels I and J to evaluate the tension balance. Thus, the thread tension can be evaluated precisely in a relatively simple configuration. Further, in the present exemplary embodiment, display 72 is configured to present the images captured by the first and the second cameras 63 and 64 in addition to the result of evaluation of tension balance. Thus, the user is given better understanding on the status of the tension balance.

Figure 20B:
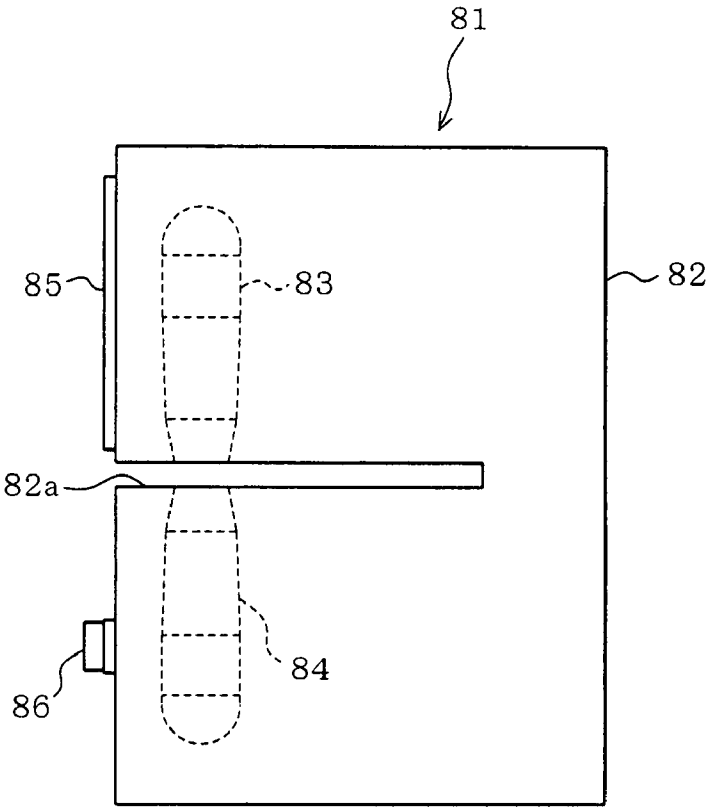
FIG. 20B is a right side view of the thread tension evaluation unit.
Figure 20A:
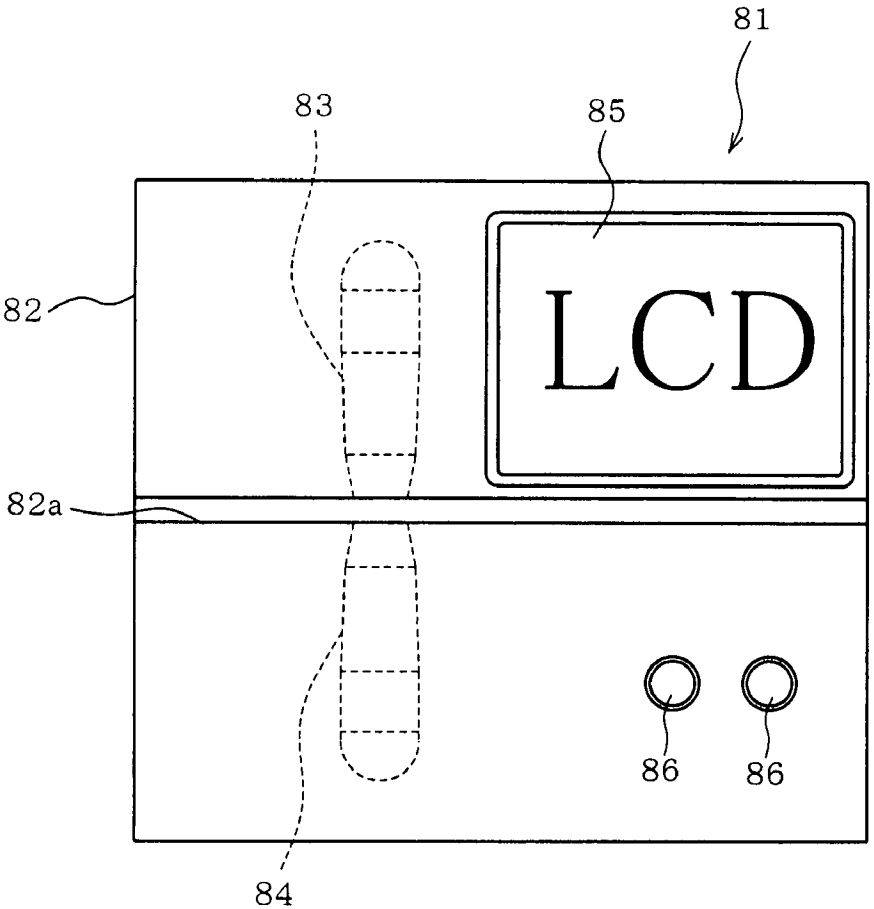
FIG. 20A is front view depicting an external configuration of a thread tension evaluation unit according to a fourth exemplary embodiment.

FIGS. 20A and 20B show the look of thread tension evaluation unit 81 according to a fourth exemplary embodiment of the present disclosure. Instead of utilizing personal computers readily available in the market to serve as thread tension evaluation unit 61, a dedicated thread tension evaluation unit 81 employed. Body case 82 of thread tension evaluation unit 81 is generally in a rectangular box form, and at its vertical mid portion, insert groove 82*a* is defined that extends horizontally rearward from the front face. Insert groove 82*a* laterally penetrates body case 82. Insert groove 82*a* receives workpiece cloth W having test stitches formed on it which is inserted by the user.

Body case 82 contains upper camera unit 83 that captures the images of stitches formed on workpiece cloth W inserted into insert groove 82*a* and a lower camera unit 84 that captures images from the underside of workpiece cloth W. Though not shown in detail, camera units 83 and 84 comprise components such as a body, lens, and lighting unit. On the front face of body case 82, display 85 comprising LCD (liquid crystal display) is provided along with a plurality of push button switches 86. The user instructs the start of thread tension evaluation process, more specifically, the image capturing of stitches formed on workpiece cloth W through depression of push button switches 86.

Though not shown, a computer that controls camera units 83 and 84, and display 85 in addition to execution of extraction, calculation and evaluation processes is provided within body case 82. The memory, more specifically, the read only memory (ROM) of the computer stores the thread tension evaluation program. Thread tension evaluation unit 81 executes the process for evaluating tension balance, which is a balance in tension between needle thread NT and bobbin thread BT of stitches formed on workpiece cloth W having test stitches formed on it, by the sewing machine by the user as in the third exemplary embodiment through execution of the thread tension evaluation program.

The thread tension evaluation program is started in response to the depression of press button switch 86 by the user with workpiece cloth W having test switches formed on it by the sewing machine inserted into insert groove 82*a*. As the first step of the process flow, the image data of the stitches are captured from both the upper and undersides of workpiece cloth W by upper camera unit 83 and lower camera unit 84. Then, based on the captured image data, a process for the region occupied by the opposite side thread appearing at interlace S is extracted whereafter areas I and J of the extracted thread region are calculated. Then, evaluation of tension balance is carried out based on calculated areas I and J and the result of evaluation is presented on display 85.

Thus, thread tension evaluating unit 81 according to the fourth exemplary embodiment automatically evaluates tension balance without relying on subjective discretion as was the case in the third exemplary embodiment to provide advantageous effects such as improving the accuracy of the evaluation of tension balance. Especially since the thread tension evaluating unit 81 is provided as a dedicated and independent unit, it provides favorable user operability in a compact and low cost configuration.

Next, a description will be given on partial modifications of the above described exemplary embodiments.

In each of the above described exemplary embodiments, evaluation is made on the tension balance by calculating the area of region occupied by the opposite side thread, in other words, the counterpart thread at one of the many interlaces S of the stitches. However, images of more than one interlace S may be captured in a single image capturing process so that tension balance is evaluated based on the areas of the regions occupied by the threads appearing at the interlaces S. Alternatively, tension balance may be evaluated based on the areas of regions occupied by threads appearing at interlaces S of a plurality of image data captured in a plurality of image capturing processes. The above arrangement reduces the impact of variation in thread tension observed in the result of sewing operation to improve the accuracy of evaluation of thread tension all the more. In such case, it is preferable to employ a median of the area and not the average.

In each of the above described exemplary embodiments, different thread colors have been used for needle thread NT and bobbin thread BT and the region or the area occupied by the respective threads have been extracted based on the thread color. However, monochrome image data may be used to extract the region occupied by the opposite side thread residing on workpiece cloth W by using the contrast of each dot. In employing such approach, a different method of image processing may be used such as obtaining the area by edge detection. Thus, if there is difference in contrast at least between needle thread NT and bobbin thread BT, evaluation of thread tension and automatic adjustment of thread tension can be made in a similar fashion with even more low cost image capturing devices.

In each of the above described exemplary embodiments, images of the stitches were captured from both the upper and the undersides of workpiece cloth W and the balance in thread tension were evaluated based on the comparison of the areas. Instead, image may be captured from only either side of workpiece cloth W in which case a predetermined value serving as a basis of evaluation is stored in the memory as a threshold value. Finally, thread tension is evaluated by comparing the calculated area with the threshold or the area serving as a basis of evaluation. The above described configuration only requires a single imaging device (camera) and thus, simplifies the process required for the evaluation.

In each of the above described exemplary embodiments, evaluation and automatic adjustment of thread tension/tension are carried out by the user when the sewing machine is actually used. However, similar adjustment in tension balance may be made during the manufacture of the sewing machine, factory shipment, or during maintenance. The imaging device may be provided as a separate accessory that is mounted on the outer surface of the sewing machine body. The overall configuration of the sewing machine body and the configuration of the thread tension adjustment mechanism may be modified as required.

In the above described third and the fourth exemplary embodiments, the result of thread tension evaluation is presented on display 72 and 85. Alternatively, if the thread tension evaluation unit and the sewing machine can be connected directly through interfaces such as USB connectors, the data indicating the result of thread tension evaluation may be transmitted to the sewing machine. In such case, the result of thread tension evaluation may be displayed on the display provided at the sewing machine. If the sewing machine is provided with an automatic thread tension adjustment unit, the automatic thread tension adjustment unit may be automatically modified based on the data indicating the result of thread tension evaluation.

In the above described third and fourth exemplary embodiments, the thread tension evaluation unit is used by the sewing machine user. However, needless to say, the thread tension evaluation unit may be used in adjustment in tension balance during manufacturing of the sewing machine, factory shipment, or during maintenance. Further, the thread tension evaluation unit may be configured to read the thread tension evaluation program which is provided through other medium such as flash memory and memory card, or downloaded directly to the thread tension evaluation unit over the network. The mechanical configuration and screen layout of the screens to be displayed on display may be modified as required.

The foregoing description and drawings are merely illustrative of the principles of the present disclosure and are not to be construed in a limited sense. Various changes and modifications will become apparent to those of ordinary skill in the art. All such changes and modifications are seen to fall within the scope of the disclosure as defined by the appended claims.

What is claimed is:

1. A sewing machine, comprising:

a feed mechanism that is configured to transfer a workpiece cloth;

a stitch forming mechanism that is configured to form stitches on the workpiece cloth being transferred by the feed mechanism by interlacing a needle thread and a bobbin thread;

a thread tension adjustment mechanism that is configured to adjust at least either a needle thread tension applied on the needle thread and a bobbin thread tension applied on the bobbin thread;

an image capturing unit that is disposed at a position capable of capturing images of the stitches formed on the workpiece cloth and that is configured to capture images of the stitches at least either upper and undersides of the workpiece cloth;

an extracting section that is configured to extract, from the image data of the stitches captured by the image capturing unit, a region of the image data, which corresponds to a portion that is occupied by an opposite side thread appearing at an interlace of the needle thread and the bobbin thread;

a calculating section that is configured to calculate an area of the region of the image data extracted by the extracting section;

an evaluating section that is configured to evaluate a tension balance between the needle thread and the bobbin thread based on the area calculated by the calculating section; and a controller that is configured to control the thread tension adjustment mechanism to modify the tension balance of the stitches formed by the stitch forming mechanism based on a result of evaluation by the evaluating section.

2. The sewing machine according to claim 1, wherein the image capturing unit captures the images of both the upper and undersides of the workpiece cloth, and wherein the calculating section calculates the area based on a count of pixels within the region occupied by the opposite side thread extracted by the extracting section.

3. The sewing machine according to claim 1, wherein the evaluating section evaluates the tension balance based on areas of regions occupied by opposite side threads appearing at a plurality of interlaces contained in a single image data.

4. The sewing machine according to claim 1, wherein the evaluating section evaluates the tension balance based on areas of regions occupied by opposite side threads appearing at interlaces contained in a plurality of image data captured by a plurality times of image capturing.

5. The sewing machine according to 1, further comprising a display unit, the display unit including a display controller that is configured to display the result of evaluation at the evaluating section and the images captured by the image capturing unit.

6. The sewing machine according to claim 1, wherein the thread tension adjustment mechanism includes a tension applier that is configured to apply the needle thread tension on the needle thread, an adjustment mechanism that is configured to make adjustments in the needle thread tension, and a drive motor that is configured to drive the adjustment mechanism, and wherein the controller controls the drive motor depending upon the result of evaluation at the evaluating section.

7. A non-transitory computer readable storage medium that stores a computer executable program for a sewing machine including a feed mechanism that is configured to transfer a workpiece cloth, a stitch forming mechanism that is configured to form stitches on the workpiece cloth being transferred by the feed mechanism by interlacing a needle thread and a bobbin thread, a thread tension adjustment mechanism that is configured to adjust at least either a needle thread tension applied on the needle thread and a bobbin thread tension applied on the bobbin thread, and an image capturing unit that is disposed at a position capable of capturing images of the stitches formed on the workpiece cloth and that is configured to capture images of the stitches at least from either upper and undersides of the workpiece cloth, the program, comprising:

instructions for capturing images of the stitches at least from either upper and undersides of the workpiece cloth by the image capturing unit;

instructions for extracting, from the image data of the stitches captured by the image capturing unit, a region of the image data, which corresponds to a portion that is occupied by an opposite side thread appearing at an interlace of the needle thread and the bobbin thread;

instructions for calculating an area of the extracted region of the image data;

instructions for evaluating a tension balance between the needle thread and the bobbin thread based on the area calculated; and instructions for modifying the tension balance of the stitches formed by the stitch forming mechanism through control of the thread tension adjustment mechanism based on a result of the evaluation.

8. The non-transitory computer readable storage medium according to claim 7, wherein the thread tension adjustment program evaluates the tension balance by:

capturing the images of the stitches formed on the workpiece cloth from both the upper and undersides of the workpiece cloth, calculating the area based on pixels within the extracted region occupied by the opposite side thread, and comparing the calculated area.

9. The non-transitory computer readable storage medium according to claim 7, wherein the tension balance is evaluated based on areas of regions occupied by the opposite side threads appearing at a plurality of interlaces contained in a single image data.

10. The non-transitory computer readable storage medium according to claim 7, wherein the tension balance is evaluated based on areas of regions occupied by opposite side threads appearing at the interlaces contained in a plurality of image data captured by a plurality times of image capturing.

11. The non-transitory computer readable storage medium according to claim 7, further comprises;

instructions for displaying result of evaluation to a display unit capable of displaying various sewing information, and instructions for displaying the captured images to the display unit.

12. The non-transitory computer readable storage medium according to claim 7, wherein the thread tension adjustment mechanism further comprises a tension applier that is configured to apply the needle thread tension on the needle thread, an adjustment mechanism that is configured to adjust the needle thread tension, and a drive motor that is configured to drive the thread tension adjustment mechanism, and the program further comprises instructions for controlling the drive motor based on the result of evaluation when modifying the tension balance of the stitches.

13. A thread tension evaluation unit that evaluates tension balance of a needle thread and a bobbin thread being interlaced to form stitches on a workpiece cloth, the thread tension evaluation unit, comprising:

an image capturing unit that captures images of the stitches at least from either upper and undersides of the workpiece cloth;

an extracting section that extracts, from the image data of the stitches captured by the image capturing unit, a region of the image data, which corresponds to a portion that is occupied by an opposite side thread appearing at an interlace of the needle thread and the bobbin thread;

a calculating section that calculates an area of the region of the image data extracted by the extracting section;

an evaluating section that evaluates thread tension based on the area calculated by the calculating section; and an output unit that outputs a result of evaluation by the evaluating section.

14. The thread tension evaluating unit according to claim 13, wherein the imaging capturing unit captures images of the stitches from both upper and undersides of the workpiece cloth, and wherein the calculating section calculates the area of the region occupied by the opposite side thread extracted by the extracting section based on a count of pixels within the region, and wherein the evaluation section evaluates the thread tension by comparing the area calculated by the calculating section.

15. The thread tension evaluating unit according to claim 13, wherein the evaluation unit evaluates the thread tension based on areas of regions occupied by opposite side threads appearing at a plurality of interlaces contained in a single image data.

16. The thread tension evaluating unit according to claim 13, wherein the evaluation unit evaluates the thread tension based on areas of regions occupied by opposite side threads appearing at interlaces contained in a plurality of image data captured by a plurality times of image capturing.

17. The thread tension evaluating unit according to claim 13, wherein the output unit further comprises a display unit and displays a result of evaluation by the evaluating section and the captured images by the image capturing unit to the display unit.

* * * * *